US009360800B2

(12) United States Patent
Sato et al.

(10) Patent No.: US 9,360,800 B2
(45) Date of Patent: Jun. 7, 2016

(54) IMAGE-FORMING DEVICE HAVING WASTE DEVELOPER MATERIAL CONVEYING MECHANISM

(71) Applicants: Shougo Sato, Seto (JP); Nao Itabashi, Nagoya (JP)

(72) Inventors: Shougo Sato, Seto (JP); Nao Itabashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/982,929

(22) Filed: Dec. 29, 2015

(65) Prior Publication Data

US 2016/0109828 A1 Apr. 21, 2016

Related U.S. Application Data

(60) Division of application No. 14/457,102, filed on Aug. 11, 2014, now Pat. No. 9,239,560, which is a continuation of application No. 13/363,113, filed on Jan. 31, 2012, now Pat. No. 8,805,264.

(30) Foreign Application Priority Data

Feb. 21, 2011 (JP) ..... 2011-034345
Feb. 21, 2011 (JP) ..... 2011-034346

(51) Int. Cl.
*G03G 15/08* (2006.01)

(52) U.S. Cl.
CPC ..... *G03G 15/0886* (2013.01)

(58) Field of Classification Search
CPC ..... G03G 15/0886
See application file for complete search history.

(56) References Cited

U.S. PATENT DOCUMENTS 4,138,687 A 2/1979 Cha et al.
5,608,501 A 3/1997 Makino
5,842,091 A 11/1998 Nakano (Continued)

FOREIGN PATENT DOCUMENTS

JP S61-129665 A 6/1986
JP S62-116970 A 5/1987

(Continued)

OTHER PUBLICATIONS

Japan Patent Office, Notification of Reason for Refusal for Japanese Patent Application No. 2011-034346 (counterpart to parent U.S. Appl. No. 13/363,113), dispatched Feb. 5, 2013.

(Continued)

*Primary Examiner* — G. M. Hyder
(74) *Attorney, Agent, or Firm* — Baker Botts L.L.P.

(57) ABSTRACT

In an image-forming device, a waste developer material accommodating part is provided integrally with a developer material accommodating part and is configured to accommodate waste developer material collected by a recovering unit. A waste developer material conveying mechanism is connected to both of the recovering unit and the waste developer material accommodating part and conveys the waste developer material from the recovering unit to the waste developer material accommodating part. The waste developer material conveying mechanism includes a conveying member that is disposed outside the waste developer material accommodating part and that is coupled to a center region of the waste developer material accommodating part along an axial direction of the photosensitive drum.

3 Claims, 31 Drawing Sheets

(56) References Cited

U.S. PATENT DOCUMENTS

| | | | | |
|---|---|---|---|---|
| 6,226,490 | B1 | 5/2001 | Fujita et al. | |
| 6,339,689 | B1 | 1/2002 | Sugiura | |
| 7,965,957 | B2 | 6/2011 | Kubota et al. | |
| 8,116,662 | B2 | 2/2012 | Ohta | |
| 8,131,183 | B2 | 3/2012 | Ito | |
| 8,208,832 | B2 | 6/2012 | Yoshida et al. | |
| 8,315,537 | B2 | 11/2012 | Miyahara et al. | |
| 8,351,819 | B2 | 1/2013 | Sakuma | |
| 8,369,745 | B2 | 2/2013 | Sato | |
| 8,737,867 | B2 | 5/2014 | Sato | |
| 8,805,264 | B2 | 8/2014 | Sato et al. | |
| 2004/0009009 | A1 | 1/2004 | Beaufort | |
| 2005/0008416 | A1 | 1/2005 | Serizawa et al. | |
| 2006/0204249 | A1 | 9/2006 | Sugiyama | |
| 2006/0257163 | A1 | 11/2006 | Sato | |
| 2007/0183814 | A1 | 8/2007 | Kamimura | |
| 2007/0248390 | A1 | 10/2007 | Kubota et al. | |
| 2008/0145119 | A1 | 6/2008 | Tatsumi et al. | |
| 2008/0199234 | A1 | 8/2008 | Hagi et al. | |
| 2008/0267661 | A1 | 10/2008 | Yoshida et al. | |
| 2008/0279581 | A1 | 11/2008 | Shimizu | |
| 2009/0035014 | A1 | 2/2009 | Sato | |
| 2009/0136259 | A1 | 5/2009 | Ito | |
| 2009/0154973 | A1 | 6/2009 | Shimizu et al. | |
| 2009/0232548 | A1 | 9/2009 | d'Entrecasteaux | |
| 2009/0285593 | A1 | 11/2009 | Sakuma | |
| 2009/0324284 | A1 | 12/2009 | Ohta | |
| 2010/0028041 | A1 | 2/2010 | Sakuma | |
| 2010/0080600 | A1 | 4/2010 | Okamoto et al. | |
| 2010/0080615 | A1 | 4/2010 | Kikuchi | |
| 2010/0209157 | A1 | 8/2010 | Sato et al. | |
| 2010/0272467 | A1 | 10/2010 | Sato | |
| 2012/0213547 | A1 | 8/2012 | Sato | |
| 2012/0213566 | A1* | 8/2012 | Sato | G03G 21/105 399/358 |
| 2012/0213567 | A1 | 8/2012 | Sato et al. | |
| 2012/0251160 | A1 | 10/2012 | Sato | |
| 2014/0334859 | A1 | 11/2014 | Sato | |

FOREIGN PATENT DOCUMENTS

| | | | |
|---|---|---|---|
| JP | S63-073776 | U | 5/1988 |
| JP | H03-051455 | U | 5/1991 |
| JP | H05-232845 | A | 9/1993 |
| JP | H06-015066 | U | 2/1994 |
| JP | H06-021050 | U | 3/1994 |
| JP | H07-225514 | A | 8/1995 |
| JP | H09-319207 | A | 12/1997 |
| JP | H10-333520 | A | 12/1998 |
| JP | 2000-098841 | A | 4/2000 |
| JP | 2006-343359 | A | 12/2006 |
| JP | 2007-178654 | A | 7/2007 |
| JP | 2008-224820 | A | 9/2008 |
| JP | 2008-276137 | A | 11/2008 |
| JP | 2009-128754 | A | 6/2009 |
| JP | 2009-276438 | A | 11/2009 |
| JP | 2010-008472 | A | 1/2010 |
| JP | 2010-038947 | A | 2/2010 |
| JP | 2010-102285 | A | 5/2010 |
| JP | 2010-122245 | A | 6/2010 |
| JP | 2010-151996 | A | 7/2010 |
| JP | 2010-191012 | A | 9/2010 |
| JP | 2010-191013 | A | 9/2010 |
| JP | 2010-256827 | A | 11/2010 |
| JP | 2011-017939 | A | 1/2011 |
| JP | 2012-173454 | A | 9/2012 |
| JP | 2012-173456 | A | 9/2012 |
| JP | 2012-173457 | A | 9/2012 |

OTHER PUBLICATIONS

United States Patent and Trademark Office, Notice of Allowance for U.S. Appl. No. 13/362,356, mailed Oct. 29, 2013.

United States Patent and Trademark Office, Office Action for U.S. Appl. No. 13/362,653, dated Sep. 12, 2013.

Japan Patent Office, Machine Translation of JP2010-008472 A.

* cited by examiner

IMAGE-FORMING DEVICE HAVING WASTE DEVELOPER MATERIAL CONVEYING MECHANISM

CROSS-REFERENCE TO RELATED APPLICATION

This application is a divisional of U.S. patent application Ser. No. 14/457,102, filed on Aug. 11, 2014, which is a continuation of U.S. patent application Ser. No. 13/363,113, filed on Jan. 31, 2012 and now issued as U.S. Pat. No. 8,805,264B2, which claims priority from Japanese Patent Applications No. 2011-034345 filed Feb. 21, 2011 and No. 2011-034346 filed Feb. 21, 2011. The contents of the above noted applications are incorporated herein by reference in their entirety.

TECHNICAL FIELD

The present invention relates to an image-forming device, such as a color printer, and a developer material unit for being mounted in the image-forming device.

BACKGROUND

One type of image-forming device is equipped with photosensitive drums arranged in tandem and parallel to one another. Four photosensitive drums are typically provided for the four colors yellow, magenta, cyan, and black. The image-forming device also has an endless conveying belt disposed in contact with all photosensitive drums for conveying sheets of paper so that the sheets sequentially contact each of the photosensitive drums. Toner images formed on the photosensitive drums are transferred onto the sheet of paper conveyed by the conveying belt, forming a color image on the paper with the superposed images of each color.

Since residual toner remaining on the photosensitive drums after an image-forming operation can become deposited on the conveying belt, a cleaning member is generally provided for removing toner from the conveying belt. Toner removed from the conveying belt by the cleaning member is conveyed to a waste toner collecting unit for storage. An image-forming device that integrally provides the waste toner collecting unit with a developer cartridge has been proposed. When the developer cartridge runs out of toner, the waste toner collecting unit is replaced together with the developer cartridge.

An image-forming device that has a photosensitive drum and a developing unit, to which a toner box accommodating toner therein is detachably mounted, has also been proposed. The toner box is formed with a toner discharging opening for discharging toner to the developing unit. A shutter is slidably mounted on the toner box to open/close the toner discharging opening. After the toner box is mounted to the developing unit, the shutter is moved to open the toner discharging opening, thereby supplying toner to the developing unit. Before the toner box is detached from the developing unit, the shutter is moved to close the toner discharging opening, thereby preventing toner from leaking out of the toner discharging opening when the toner box is detached from the developing unit.

SUMMARY

An object of the present invention is to provide an improved image-forming device and an improved developer material unit.

In order to attain the above and other objects, the invention provides an image-forming device. The image-forming device may include: a photosensitive drum; a developer material accommodating part; a developing roller; a recovering unit; a waste developer material accommodating part; and a waste developer material conveying mechanism. The developer material accommodating part may be configured to accommodate developer material. The developing roller may be configured to supply the photosensitive drum with the developer material accommodated in the developer material accommodating part. The recovering unit may be configured to remove, from a target for waste developer material recovery, waste developer material to be discarded from the target and collect the waste developer material. The waste developer material accommodating part may be provided integrally with the developer material accommodating part and configured to accommodate waste developer material collected by the recovering unit. The waste developer material conveying mechanism may be configured to be connected to both of the recovering unit and the waste developer material accommodating part and to convey the waste developer material from the recovering unit to the waste developer material accommodating part. The waste developer material conveying mechanism may include a conveying member. The conveying member may be disposed outside the waste developer material accommodating part and coupled to a center region of the waste developer material accommodating part along an axial direction of the photosensitive drum.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, embodiments of the present invention will be described while referring to the accompanying drawings.

1. Color Printer

Figure 1:
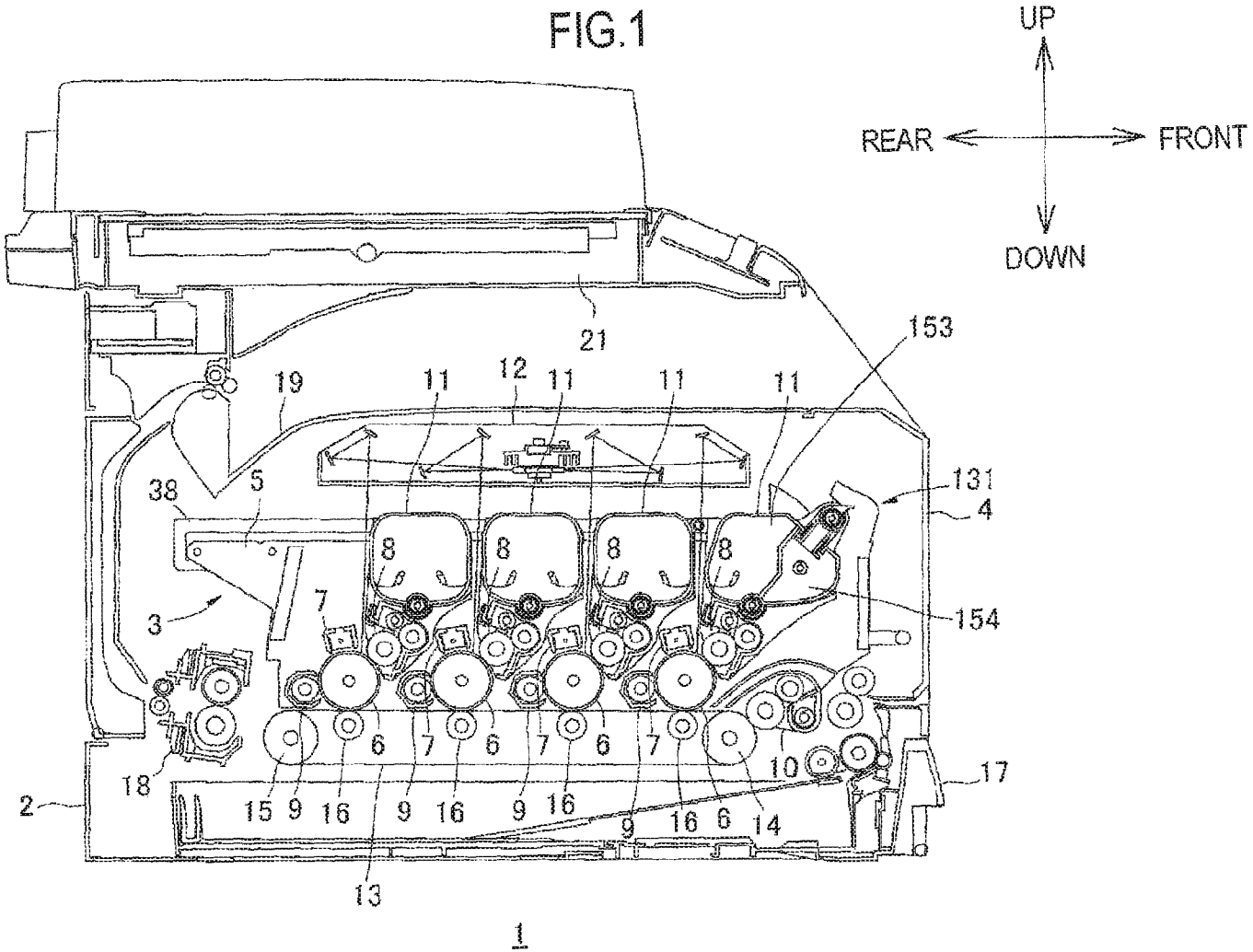
FIG. 1 is a cross-sectional view of a color printer according to an embodiment of the present invention, in which a drawer unit is in an accommodated position.
Figure 2:
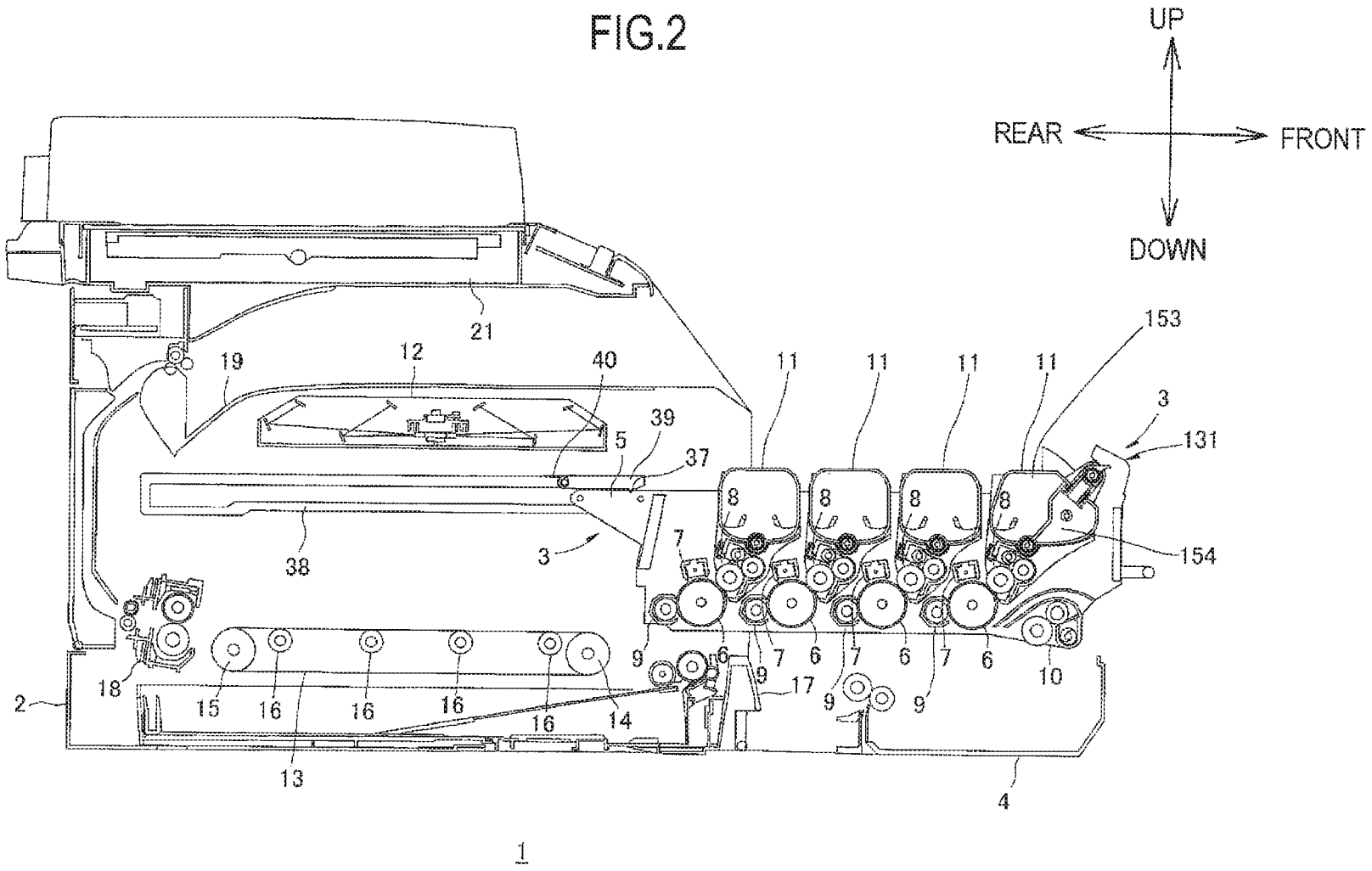
FIG. 2 is a cross-sectional view of the color printer of FIG. 1, in which the drawer unit is in a pulled-out position.
Figure 3:
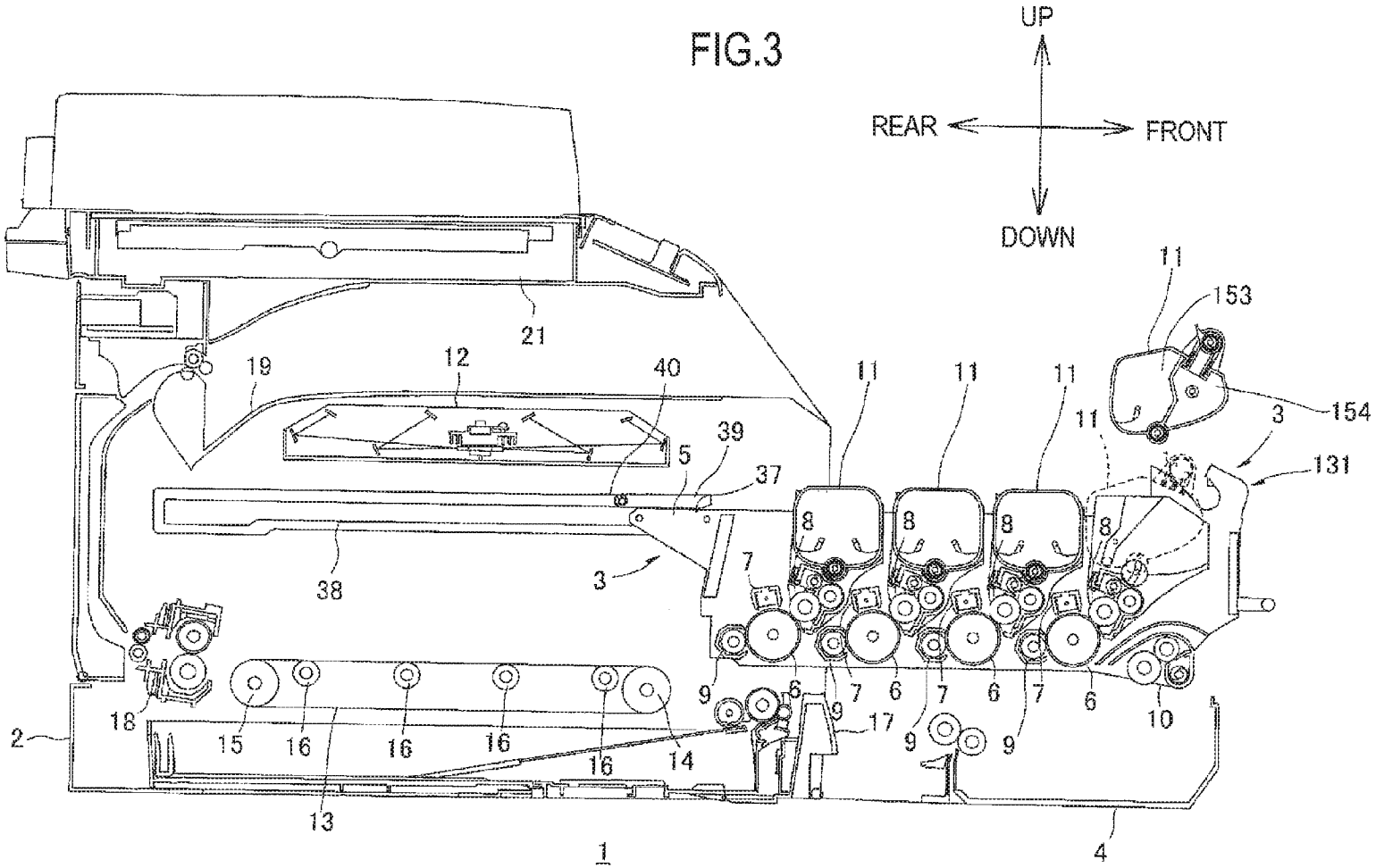
FIG. 3 is a cross-sectional view of the color printer of FIG. 1, in which the drawer unit is in the pulled-out position and a black toner unit is detached from the drawer unit.

As shown in FIGS. 1, 2, and 3, the image-forming device according to the embodiment is a tandem-type color printer 1. The color printer 1 includes a main casing 2. A drawer unit 3 is mounted inside the main casing 2. A front cover 4 is provided on the front surface of the main casing 2 and is capable of being opened and closed thereon. When the front cover 4 is open, the drawer unit 3 can be moved horizontally between an accommodated position inside the main casing 2 (the position shown in FIG. 1) and a pulled-out position outside the main casing 2 (the position shown in FIG. 2). In the pulled-out position, part of the drawer unit 3 remains inside the main casing 2, while the top of the drawer unit 3 outside the main casing 2 is exposed to reveal four toner units 11 (described later) mounted therein.

In the following description, the side of the color printer 1 on which the front cover 4 is provided (the side that a user faces when operating the color printer 1) will be considered the front side of the color printer 1 relative to a front-to-rear direction. A direction orthogonal to a flat surface on which the color printer 1 rests will be considered the vertical (an up-to-down direction). The left and right sides of the color printer 1 are defined based on the reference of a user facing the front side of the color printer 1 when the color printer 1 rests on a flat surface.

The drawer unit 3 is provided with a drawer frame 5. Four photosensitive drums 6 are rotatably retained in the drawer frame 5. More specifically, the photosensitive drums 6 are retained in the drawer frame 5 so that the peripheral surfaces of the photosensitive drums 6 are capable of circulating about axes extending in the left-to-right direction. The four photosensitive drums 6 are respectively provided for the colors black, yellow, magenta, and cyan and are arranged at regular intervals along the front-to-rear direction from the front to the rear according to the order of colors given above. In other words, the photosensitive drums 6 are juxtaposed with one another and arm arranged spaced apart from one another by the same gap in the front-to-rear direction.

The drawer frame 5 also retains four chargers 7, four developing units 8, and four drum cleaners 9 for the four colors black, yellow, magenta, and cyan. One each of the chargers 7, developing units 8, and drum cleaners 9 is arranged circumferentially around the corresponding photosensitive drum 6. The chargers 7 are disposed above the corresponding photosensitive drums 6. The developing units 8 are disposed diagonally above and forward of the corresponding photosensitive drums 6. The drum cleaners 9 are disposed on the rear of the corresponding photosensitive drums 6.

The drawer frame 5 also retains a belt cleaner 10.

Four toner units 11 are detachably retained in the drawer frame 5 at positions above the corresponding developing units 8. The toner units 11 supply toner to the developing units 8. As illustrated in FIG. 3, the toner units 11 are detachably mounted in the top of the drawer frame 5 while the drawer unit 3 is in the pulled-out position.

An exposure device 12 is provided in the uppermost section of the main casing 2. The exposure device 12 irradiates four laser beams corresponding to the four colors used by the color printer 1.

During an image-forming operation, the photosensitive drums 6 rotate clockwise in a left side view. As each photosensitive drum 6 rotates, the corresponding charger 7 applies a uniform charge to the surface of the photosensitive drum 6 through corona discharge. Subsequently, the exposure device 12 irradiates laser beams for selectively exposing the surfaces of the photosensitive drums 6. This exposure removes charge from the surfaces of the photosensitive drums 6, forming electrostatic latent images thereon. The corresponding developing units 8 then supply toner to develop the latent images into toner images.

A sheet-conveying belt 13 is provided inside the main casing 2 at a position slightly below the vertical center of the main casing 2. The sheet-conveying belt 13 is an endless belt and is looped about two rollers 14 and 15. The rollers 14 and 15 are disposed in approximately the same vertical position, but are spaced apart in the front-to-rear direction. By placing the sheet-conveying belt 13 around the rollers 14 and 15, the upper portion of the belt loop between the top edges of the rollers 14 and 15 forms a flat portion that extends in both front-to-rear and left-to-right directions. This flat portion contacts the four photosensitive drums 6.

Transfer rollers 16 are disposed inside the loop of the sheet-conveying belt 13 at positions confronting corresponding photosensitive drums 6 through the flat portion of the sheet-conveying belt 13.

A sheet cassette 17 accommodating sheets of paper is disposed in a bottom section of the main casing 2. Various rollers are provided for conveying sheets of paper from the sheet cassette 17 onto the flat portion of the sheet-conveying belt 13. The sheet-conveying belt 13 then conveys the sheets of paper rearward sequentially through positions between the sheet-conveying belt 13 and each of the photosensitive drums 6.

During an image-forming operation, the sheet-conveying belt 13 circulates counterclockwise in a left side view. Toner images formed on the surfaces of the photosensitive drums 6 are sequentially transferred, beginning from the black toner image, and superposed on the sheet of paper conveyed by the sheet-conveying belt 13 through the function of the transfer rollers 16, forming a color toner image on the paper from the superposed toner images.

A fixing unit 18 is positioned on the rear side of the sheet-conveying belt 13. Sheets of paper are conveyed to the fixing unit 18 after toner images have been transferred onto the sheets. The fixing unit 18 fixes the toner images to the sheets of paper with heat and pressure. Once the toner images have been fixed in the fixing unit 18, various rollers discharge the sheets into a discharge tray 19 formed on the top surface of the main casing 2.

A scanner 21 for reading data of original images is provided above the main casing 2. Hence, the color printer 1 possesses a copier function for reproducing images of original documents on paper based on data read by the scanner 21. The color printer 1 also possesses a scanner function for transmitting data of an original image read by the scanner 21 to a personal computer connected to the color printer 1. The color printer 1 also possesses a facsimile function for transmitting data of original images read by the scanner 21 to a facsimile machine through a public telephone network.

2. Drawer Unit

2-1. Drawer Frame

The drawer frame 5 is configured of a left side plate 31 shown in FIGS. 4, 5, 6, and 7, and a right side plate 32 shown in FIGS. 8, 9, 10, and 11. As shown in FIG. 12, the side plates 31 and 32 are arranged parallel to each other and separated in the left-to-right direction. As shown in FIGS. 4, 5, 8, and 9, the drawer frame 5 also includes a front beam 33 bridging the front ends of the side plates 31 and 32, and a rear beam 34 bridging the rear ends of the side plates 31 and 32.

As shown in FIG. 12, a guided part 35 is formed on the outer surface of each of the side plates 31 and 32. The guided parts 35 are formed as ridges extending along the top edges of the side plates 31 and 32. Each guided part 35 extends rearward to a position farther rearward than the rear beam 34. As shown in FIGS. 4 through 7, two rollers 36 arranged parallel to each other and separated in the front-to-rear direction are rotatably mounted in the rear end portion of each guided part 35. An engagement groove 37 is formed in the top surface of each guided part 35 at a position slightly rearward of the front roller 36. The engagement grooves 37 are V-shaped in a side view.

As shown in FIG. 2, guide parts 38 are provided in the main casing 2. The guided parts 35 are guided within the respective guide parts 38 as the drawer unit 3 is moved into and out of the main casing 2. The guide parts 38 are positioned below the exposure device 12 and extend in the front-to-rear direction. In a side view, the guide parts 38 have an angular C-shape that is elongated in the front-to-rear direction and open on the front side. The bottom portion of the guide parts 38 is a step lower near the rear end. The lower stepped portion of the guide part 38 is longer than the interval between the two rollers 36. A stopper arm 39 is attached to the front end of each guide part 38 on the upper portion thereof. The stopper arms 39 extend in the front-to-rear direction and are pivotably disposed on the guide parts 38 so that their front ends can move up and down. Springs 40 urge the front ends of the respective stopper arms 39 downward. An engaging protrusion is formed on the front end of each stopper arm 39. The engaging protrusions are V-shaped in a side view and protrude downward.

When the drawer unit 3 is in the accommodated position, the guided parts 35 are positioned inside the guide parts 38 (between the upper portion and lower portion of the guide parts 38), and the rear rollers 36 are in contact with the rear ends of the guide parts 38. Further, the rollers 36 are positioned on the lower stepped portion of the guide parts 38. In this state, the photosensitive drums 6 are in contact with the sheet-conveying belt 13.

When the drawer unit 3 is moved from the accommodated position to the pulled-out position, the rollers 36 roll over the bottom portion of the guide parts 38, while the guided parts 35 remain supported on the bottom portion of the guide parts 38. The engaging protrusions of the stopper arms 39 are in contact with the top surfaces of the guided parts 35. When the rollers 36 leave the lower stepped portion of the guide parts 38, the drawer unit 3 rises a distance equal to the height of the step in the lower portion of the guide parts 38, causing the photosensitive drums 6 to rise up off the sheet-conveying belt 13.

When the drawer unit 3 reaches the pulled-out position shown in FIG. 2, the engaging protrusions formed on the stopper arms 39 become fitted into the respective engagement grooves 37 of the guided parts 35. This engagement fixes the drawer unit 3 relative to the main casing 2 with adequate firmness so that the drawer unit 3 is maintained in the pulled-out position.

2-2. Photosensitive Drums

As shown in FIGS. 8 through 11, each photosensitive drum 6 includes a cylindrical main drum body 41, and a drum shaft 42. The drum shaft 42 extends through the axial center of the main drum body 41 and protrudes from both ends of the same.

The main drum body 41 is rotatably supported on the drum shaft 42. While being aligned in the left-to-right direction, the drum shaft 42 is inserted into the side plates 31 and 32 and is fixed so as to be incapable of rotating relative to the side plates 31 and 32. Hence, the photosensitive drums 6 are rotatably disposed so that the peripheral surfaces of the main drum bodies 41 circulate. As shown in FIG. 12, a drum gear 43 is mounted on the right end of the main drum body 41 and is non-rotatable relative to the same. A motor (not shown) inputs a drive force into the drum gear 43.

Alternatively, the main drum body 41 may be non-rotatably supported on the drum shaft 42, the drum shaft 42 may be rotatably supported in the side plates 31 and 32, and the drum gear 43 may be fixed to the drum shaft 42.

2-3. Chargers

As shown in FIGS. 8 through 11, the chargers 7 are held in charger retaining units 51. Each charger retaining unit 51 spans between the side plates 31 and 32 at a position above the corresponding photosensitive drum 6. The charger retaining units 51 have a substantially angular C-shape in cross section that is open on the photosensitive drum 6 side. Each charger 7 includes a discharge wire 52 extending in the left-to-right direction within the charger retaining unit 51, and a shielding case 53 for covering the open side of the charger retaining unit 51. The shielding case 53 has a substantially angular C-shape in cross section that is open on the side opposite the photosensitive drum 6. When a high voltage is applied to the discharge wire 52, the discharge wire 52 produces a corona discharge to charge the surface of the photosensitive drum 6. A grid electrode 54 is formed on the surface of the shielding case 53 opposing the photosensitive drum 6 for regulating the amount of charge that is applied to the photosensitive drum 6.

2-4. Developing Units

As shown in FIGS. 8, 9, 12, 13, and 14, each developing unit 8 has a case 61. The case 61 includes a pair of side plates 62 arranged parallel to each other and separated in the left-to-right direction. As shown in FIGS. 8, 9, 13, 14, a developing chamber 63 and a mounting space 64 for receiving a corresponding toner unit 11 are formed between the left and right side plates 62.

Figure 13:
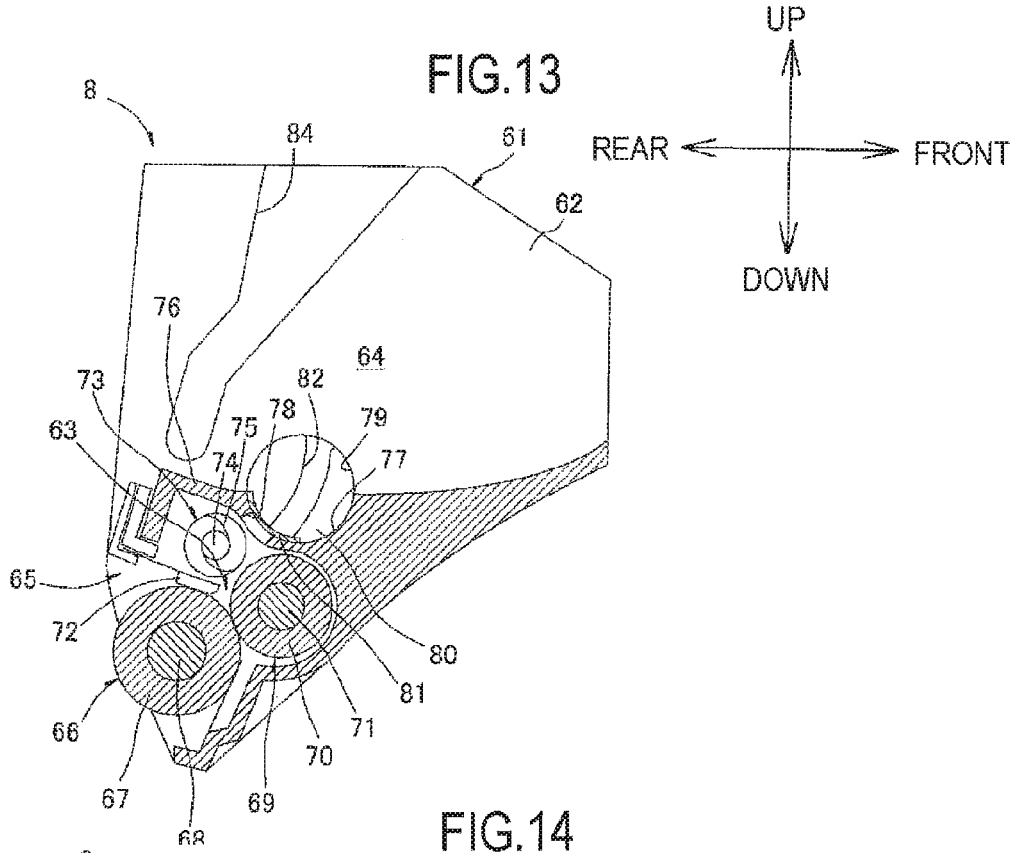
FIG. 13 is a cross-sectional view of the developing unit, in which the developing-unit-side shutter is in the closed position.
Figure 14:
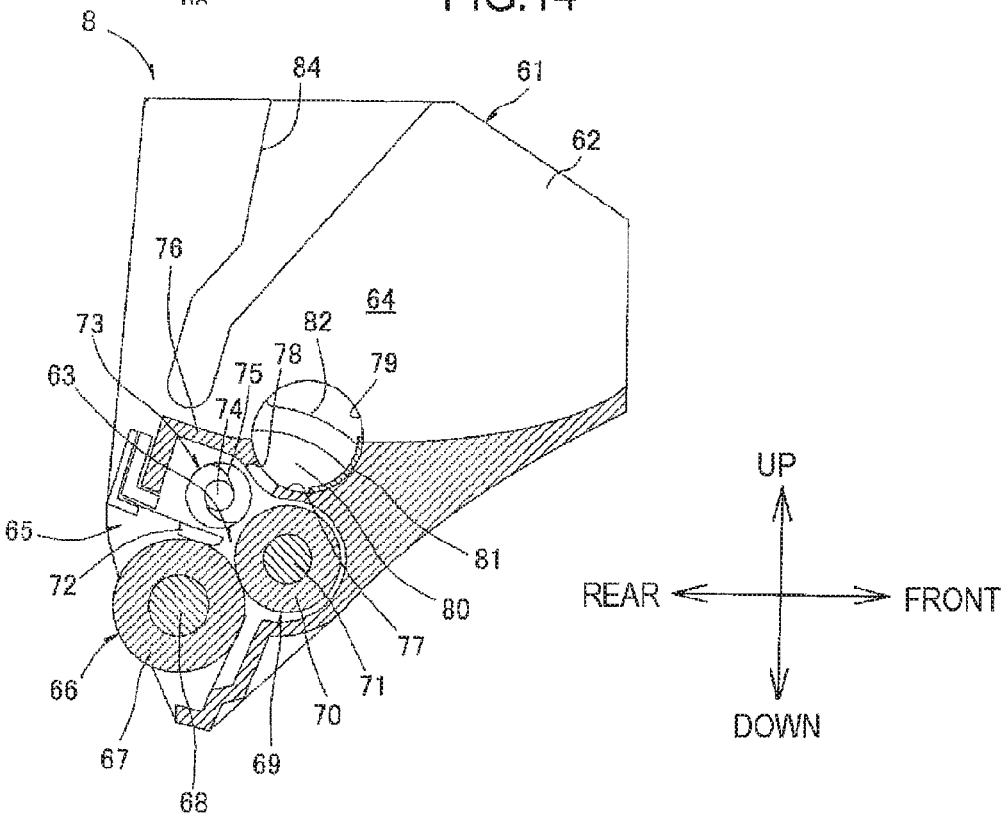
FIG. 14 is a cross-sectional view of the developing unit, in which the developing-unit-side shutter is in the open position.

As shown in FIGS. 13 and 14, an opening 65 is formed in the lower end of the case 61. The opening 65 opens toward the corresponding photosensitive drum 6.

A developing roller 66 is disposed in the bottom portion of the developing chamber 63. The developing roller 66 has a cylindrical main developing roller body 67 having a central axis that extends in the left-to-right direction, and a developing roller shaft 68 that is inserted through the main developing roller body 67 along the central axis. A portion of the peripheral surface of the main developing roller body 67 is exposed outside the case 61 through the opening 65. The developing roller shaft 68 is rotatably supported in the left and right side plates 62. The developing roller shaft 68 is inserted through the side plates 62 and protrudes on the outside of the same.

A supply roller 69 is provided in the developing chamber 63. The supply roller 69 has a cylindrical main supply roller body 70 whose central axis extends in the left-to-right direction, and a supply roller shaft 71 that is inserted through the main supply roller body 70 along the central axis. The supply roller 69 is disposed in the developing chamber 63 so that the main supply roller body 70 contacts the upper front portion of the main developing roller body 67. The supply roller shaft 71 is rotatably supported in the left and right side plates 62 and is inserted through the side plates 62 so as to protrude outward therefrom.

A thin plate-shaped thickness-regulating blade 72 is provided in a position blocking the space between the rear edge of the opening 65 and the main developing roller body 67 of the developing roller 66. One end of the thickness-regulating blade 72 is held in the case 61, while the other free end can move through flexural deformation of the thickness-regulating blade 72. The free end of the thickness-regulating blade 72 contacts the top of the main developing roller body 67.

An auger 73 is also provided in the developing chamber 63 at a position diagonally upward and rearward of the supply roller 69. The auger 73 has an auger shaft 74 extending in the left-to-right direction, and an auger screw 75 forming a helical shape around the circumference of the auger shaft 74. The auger shaft 74 is rotatably supported in the left and right side plates 62.

The case 61 also has a partitioning wall 76 for separating the developing chamber 63 and mounting space 64. A semicircular arc surface 77 is formed on the partitioning wall 76 in the portion of the partitioning wall 76 confronting the auger 73 from a position diagonally above and forward of the same. The arc surface 77 has its concave curved surface on the developing chamber 63 side. As shown in FIG. 12, through-holes 78 are formed in the left-to-right center region and both left and right end regions of the are surface 77. The through-holes 78 are rectangular and elongated in the left-to-right direction. The through-holes 78 penetrate the arc surface 77 to provide communication between the developing chamber 63 and mounting space 64.

A circular first retaining through-hole 79 is formed in each of the side plates 62. The first retaining through-holes 79 have substantially the same curvature as the top surface of the arc surface 77, so that their peripheral edges conform to the top surface of the arc surface 77. Generally disc-shaped shutter operating members 80 are rotatably held (fitted) in corresponding first retaining through-holes 79. The shutter operating members 80 have a curvature slightly less than that of the first retaining through-holes 79. As shown in FIGS. 12 through 14, a developing-unit-side shutter 81 spans between the left and right shutter operating members 80. The developing-unit-side shutter 81 has a thin plate shape that curves to conform to the top surface of the arc surface 77.

Figure 8:
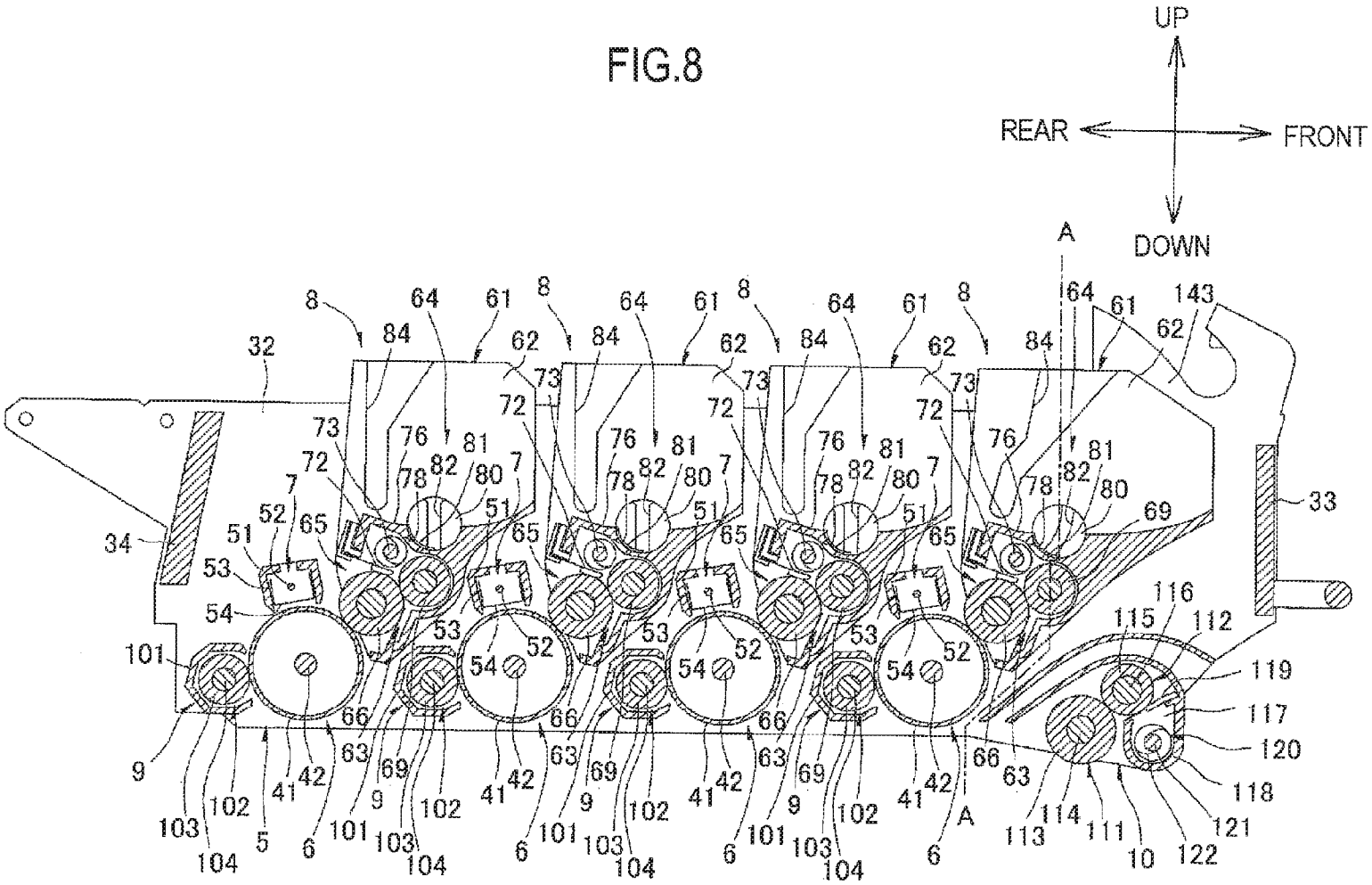
FIG. 8 is a cross-sectional view of the drawer unit, in which the developing-unit-side shutters are in a closed position.
Figure 9:
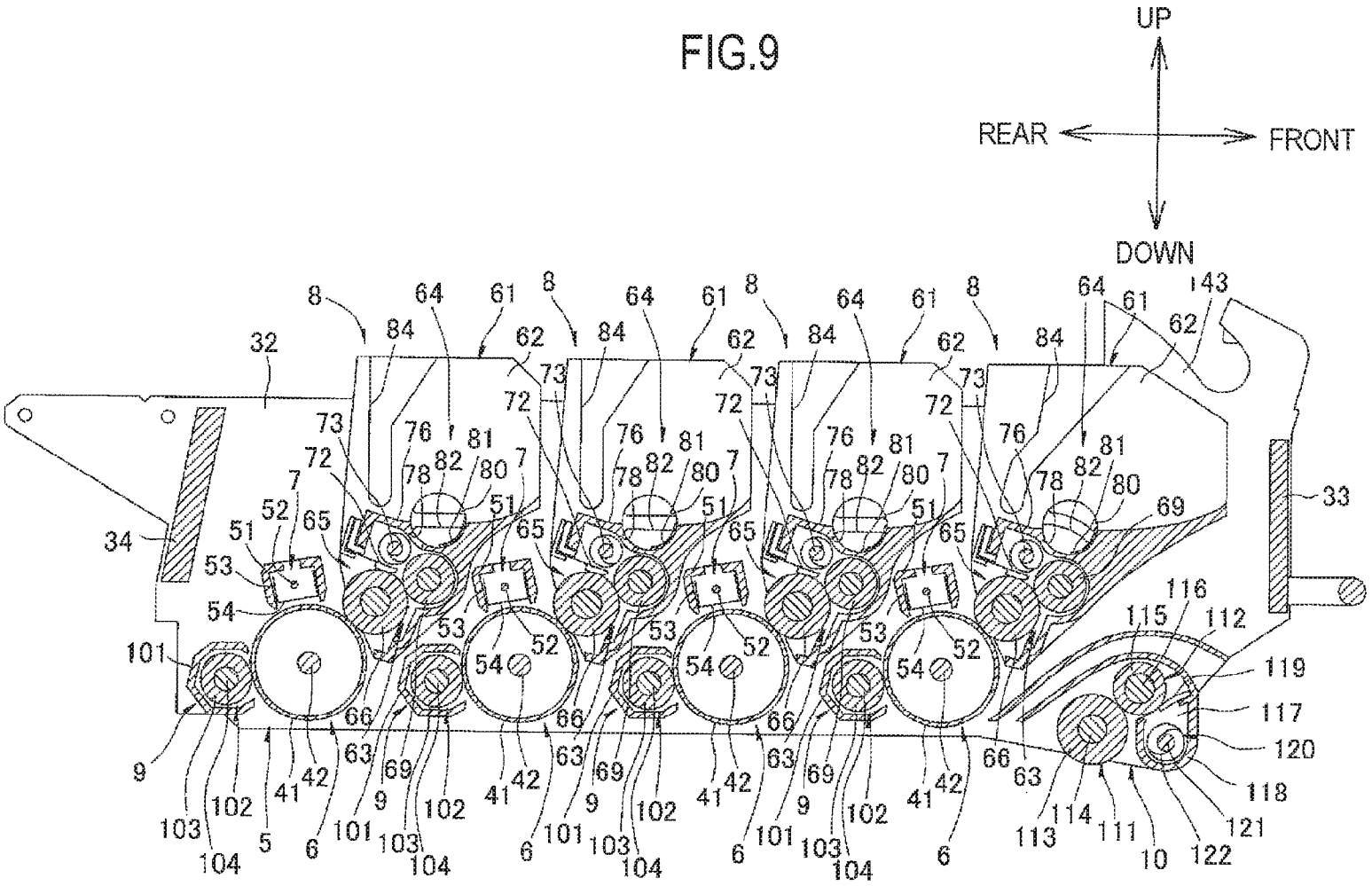
FIG. 9 is a cross-sectional view of the drawer unit, in which the developing-unit-side shutters are in an open position.

As shown in FIGS. 8 and 9, a first engagement groove 82 is formed in the inside surface of each shutter operating members 80. Each first engagement groove 82 for the yellow, magenta, and cyan developing units 8 is a single groove passing through the center of the shutter operating member 80 and extending linearly from one edge to the other, forming openings in the edge of the shutter operating member 80 at two diametrically opposing positions. The first engagement grooves 82 for the black developing unit 8, however, are slightly curved. The convex curved side of the first engagement grooves 82 faces forward when the through-holes 78 are closed by the developing-unit-side shutter 81 (see FIG. 13).

As shown in FIG. 12, a coupling protrusion 83 is formed on the outer surface of each shutter operating member 80. The coupling protrusions 83 are ridge-like protrusions that appear rectangular in a side view and extend along a diameter of the shutter operating member 80 (see FIGS. 10 and 11).

As shown in FIGS. 8 and 9, a toner unit guide groove 84 is formed in each of the left and right side plates 62. The toner unit guide grooves 84 for the black developing unit 8 extend diagonally upward and forward from a position near the partitioning wall 76, then bend slightly and proceed diagonally upward and forward along a gentler slope. The toner unit guide grooves 84 for yellow, magenta, and cyan extend upward from a position near the corresponding partitioning walls 76. Each of the toner unit guide grooves 84 gradually widens from a midway point to the upper side and is open in the top surface of the corresponding side plate 62.

2-5. Developing Unit Support Plates

Figure 10:
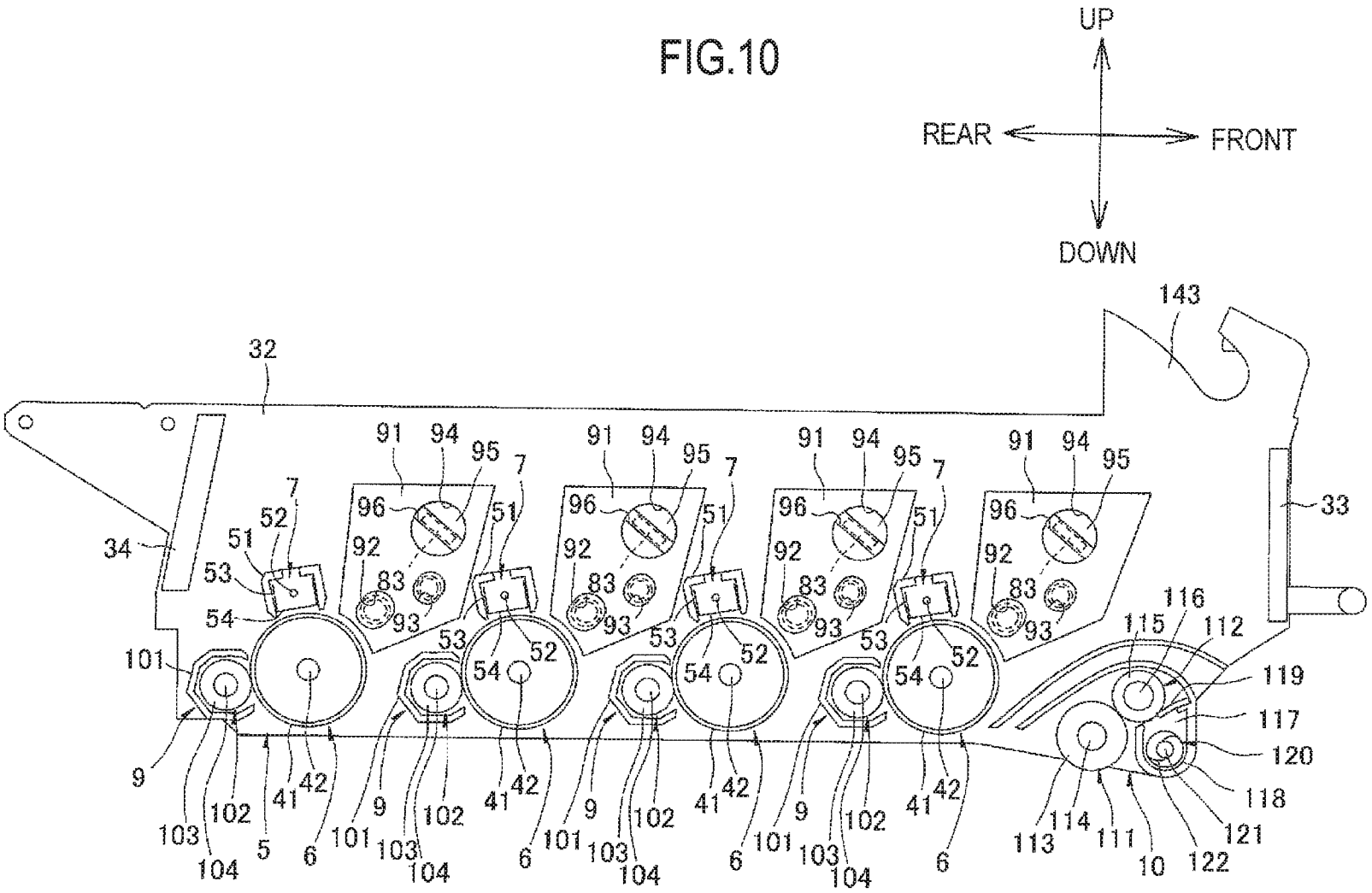
FIG. 10 is a cross-sectional view of the drawer unit, from which showing of developing units is omitted, wherein second engagement grooves are aligned in a slanted direction downward toward the front (the developing-unit-side shutters are in the closed position)
Figure 11:
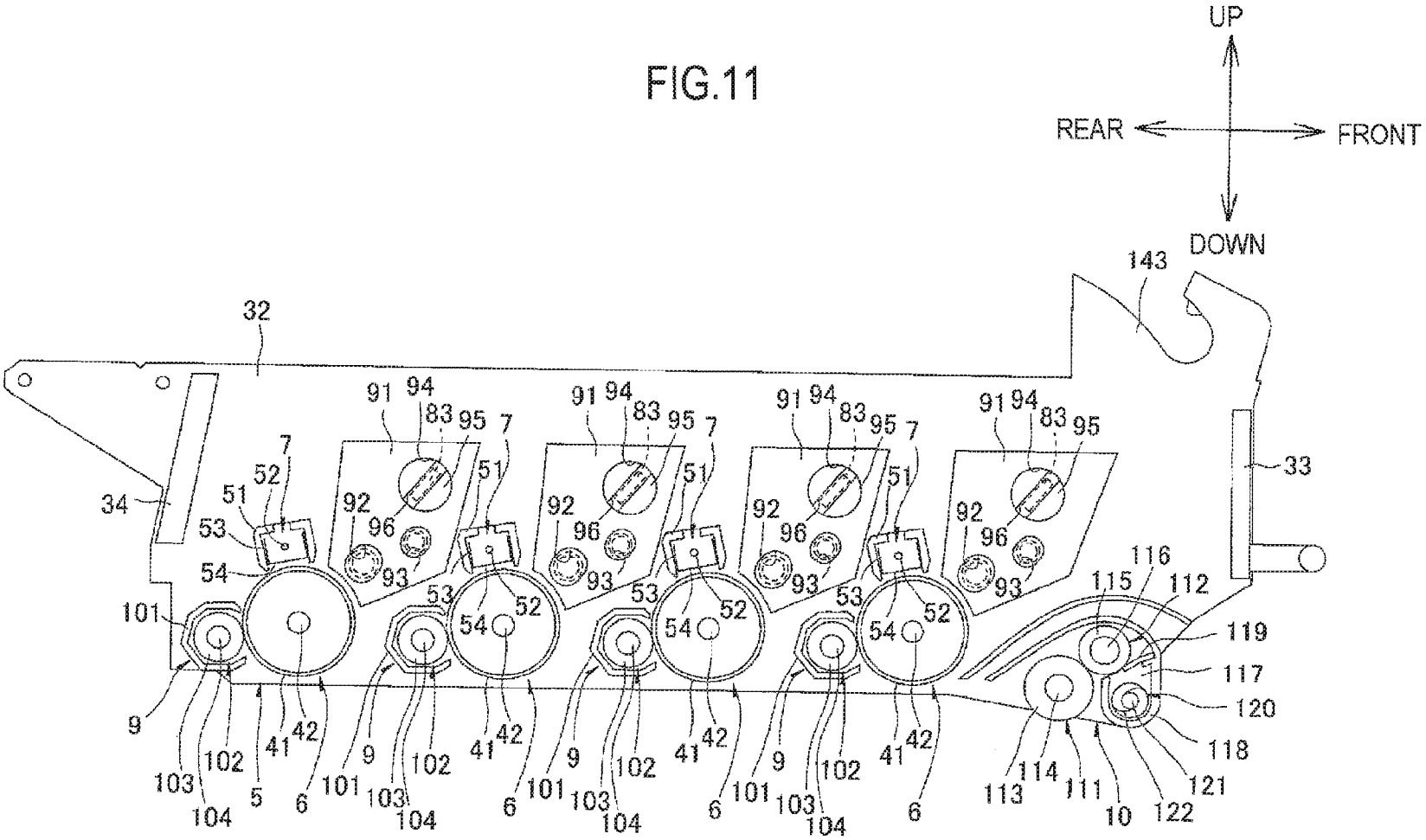
FIG. 11 is a cross-sectional view of the drawer unit, from which showing of the developing units is omitted, wherein the second engagement grooves are aligned in a slanted direction upward toward the front (the developing-unit-side shutters are in the open position)
Figure 12:
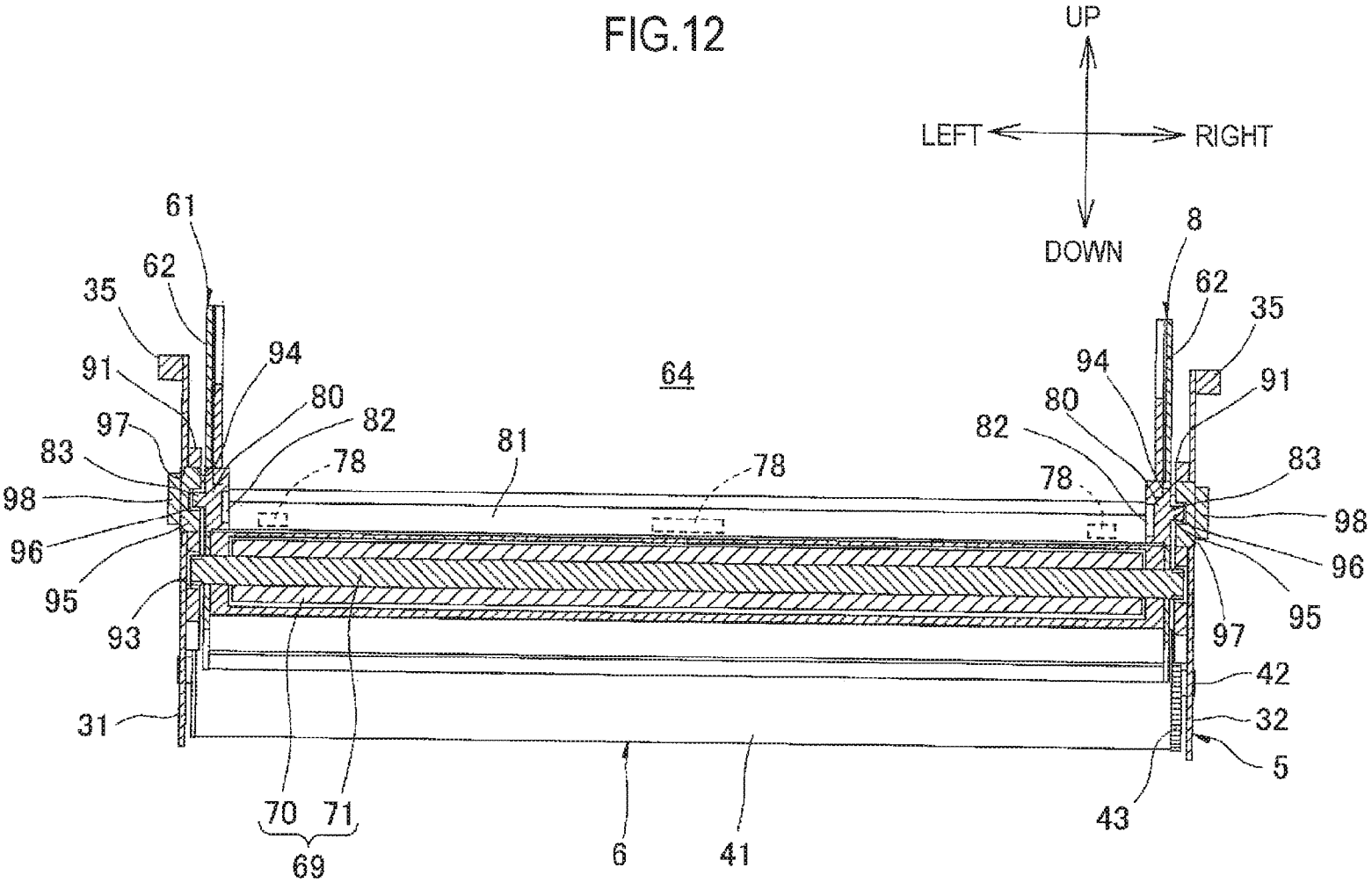
FIG. 12 is a sectional view of the drawer unit taken along a line A-A in FIG. 8 and shown from the front side to the rear side.

As shown in FIGS. 10 through 12, developing unit support plates 91 are fixed to the inner surfaces of the side plates 31 and 32 constituting the drawer frame 5.

The developing unit support plates 91 are provided at positions corresponding to the four developing units 8. Each developing unit support plate 91 has formed therein a developing roller shaft support through-hole 92 for receiving and supporting one end of the corresponding developing roller shaft 68, and a supply roller shaft support through-hole 93 for receiving and supporting one end of the corresponding supply roller shaft 71. Both the support through-holes 92 and 93 are elongated through-holes with a long axis extending obliquely upward and forward (or downward and rearward).

A circular second retaining through-hole 94 having a curvature substantially equal to that of the first retaining through-hole 79 is formed in the developing unit support plate 91 at a position opposing the shutter operating member 80 (see FIGS. 8 and 9) in the left-to-right direction. A generally disc-shaped manual operating member 95 is rotatably retained (fitted) in the second retaining through-hole 94. The manual operating member 95 has substantially the same curvature as the shutter operating member 80.

The inner surface of the manual operating member 95 is approximately flush with the inner surface of the developing unit support plate 91, as illustrated in FIG. 12. A second engagement groove 96 is formed in the inner surface of the manual operating member 95. The second engagement groove 96 is a single groove extending linearly along a diameter of the manual operating member 95 and forming openings in the circumferential edge of the manual operating member 95. The coupling protrusion 83 of the corresponding shutter operating member 80 is engaged in the second engagement groove 96.

As shown in FIGS. 4 through 7 and 12, circular through-holes 97 are formed in the side plates 31 and 32 constituting the drawer frame 5 at positions overlapping the second retaining through-holes 94 in the left-to-right direction. The through-holes 97 have the same curvature as the second retaining through-holes 94. The manual operating members 95 are fitted into corresponding through-holes 97. An operating knob 98 is formed on the outer surface of each manual operating member 95. As shown in FIGS. 4 through 7, the operating knobs 98 are formed as ridges that appear rectangular in a side view and extend along a diameter of the manual operating member 95.

2-6. Drum Cleaners

As shown in FIGS. 8 and 9, each drum cleaner 9 has a case 101. The case 101 forms a general C-shape in cross section that is open on the photosensitive drum 6 side. The cases 101 span between the side plates 31 and 32 of the drawer frame 5.

A drum cleaning roller 102 is accommodated in the case 101. The drum cleaning roller 102 has a cylindrical main roller body 103 whose central axis is oriented in the left-to-right direction, and a roller shaft 104 inserted through the main roller body 103 along its central axis. The drum cleaning roller 102 is disposed so that the main roller body 103 contacts the photosensitive drum 6.

2-7. Belt Cleaner

As shown in FIGS. 8 and 9, the belt cleaner 10 includes a primary belt cleaning roller 111, and a secondary belt cleaning roller 112.

The primary belt cleaning roller 111 is disposed in the lower front corner of the drawer frame 5. The primary belt cleaning roller 111 has a cylindrical main roller body 113 whose central axis is oriented in the left-to-right direction, and a roller shaft 114 inserted through the main roller body 113 along its central axis. When the drawer unit 3 is in the accommodated position inside the main casing 2, the main roller body 113 contacts the sheet-conveying belt 13 along substantially the entire width thereof at a position opposing the roller 14 through the sheet-conveying belt 13, as shown in FIG. 1. The roller shaft 114 is rotatably supported in the side plates 31 and 32 of the drawer frame 5.

As shown in FIGS. 8 and 9, the secondary belt cleaning roller 112 has a cylindrical main roller body 115 whose central axis is oriented in the left-to-right direction, and a roller shaft 116 inserted through the main roller body 115 along its central axis. The main roller body 115 contacts the main roller body 113 of the primary belt cleaning roller 111 along substantially its entire width from a position above and forward thereof. The roller shaft 116 is rotatably supported in the side plates 31 and 32 of the drawer frame 5.

A waste toner conveying chamber 117 is provided below the secondary belt cleaning roller 112. The waste toner conveying chamber 117 is formed by a chamber wall 118. The chamber wall 118 extends in the left-to-right direction and is generally U-shaped in cross section, opening upward. The right end of the chamber wall 118 is connected to the right side plate 32. The right side plate 32 closes the right side of the waste toner conveying chamber 117. The left end of the chamber wall 118 passes through the left side plate 31 so that the waste toner conveying chamber 117 is open on the left end.

A scraper 119 is mounted in the upper front edge of the chamber wall 118. The scraper 119 is plate-shaped and extends obliquely downward and rearward from the upper front edge of the chamber wall 118. The rear edge portion of the scraper 119 contacts the circumferential surface of the secondary belt cleaning roller 112 (the main roller body 115) along its lower front side.

An auger 120 is disposed inside the waste toner conveying chamber 117. The auger 120 is configured of an auger shaft 121 extending in the left-to-right direction, and an auger screw 122 formed in a helical shape around the circumference of the auger shaft 121. The right end of the auger shaft 121 is rotatably supported in the right side plate 32. The left end of the auger shaft 121 extends farther leftward than the left edge of the chamber wall 118.

2-8. Outer Conveying Unit

Figure 4:
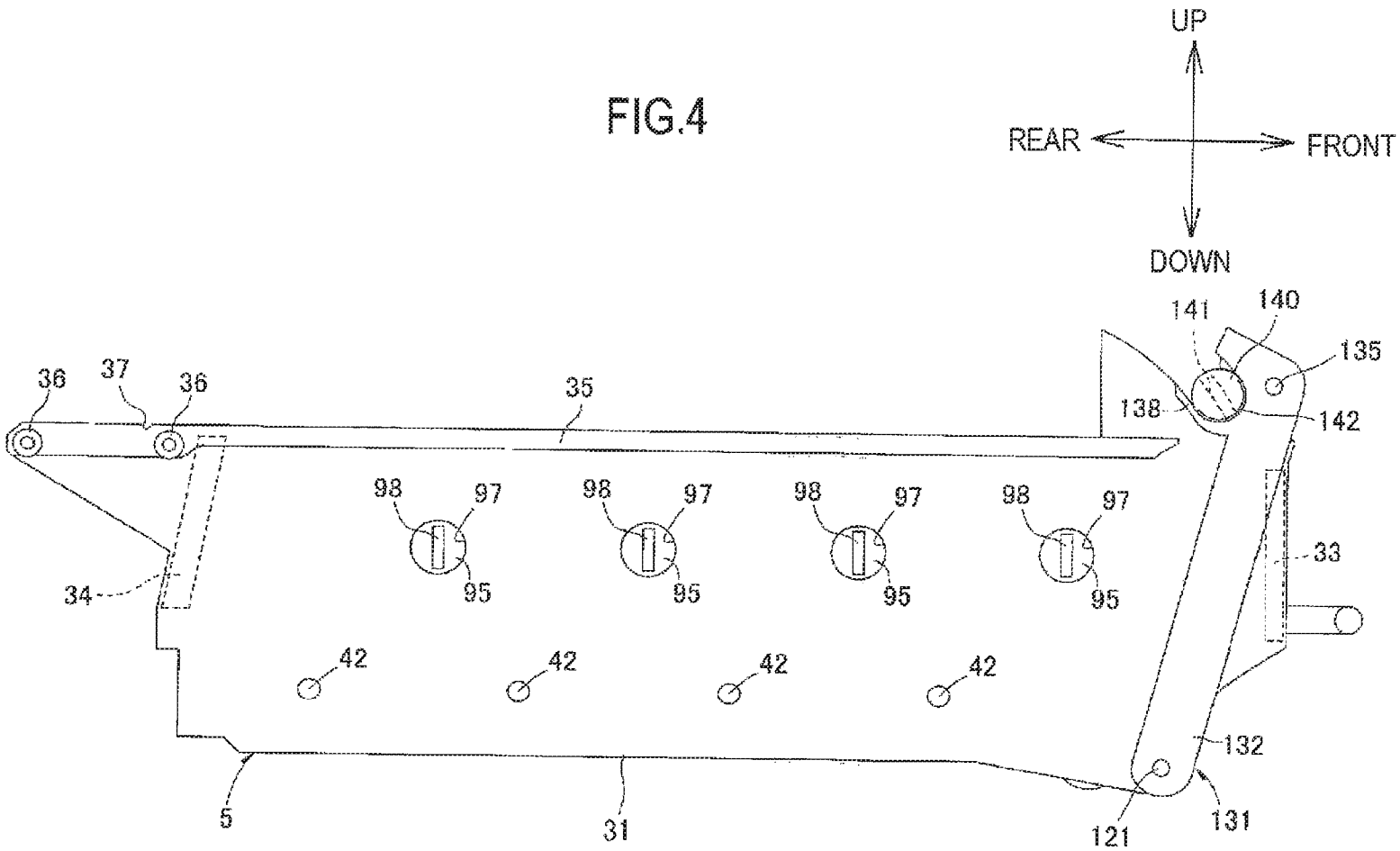
FIG. 4 is a left side view of the drawer unit, in which operating knobs are aligned in the vertical direction (developing-unit-side shutters are in a closed position)
Figure 5:
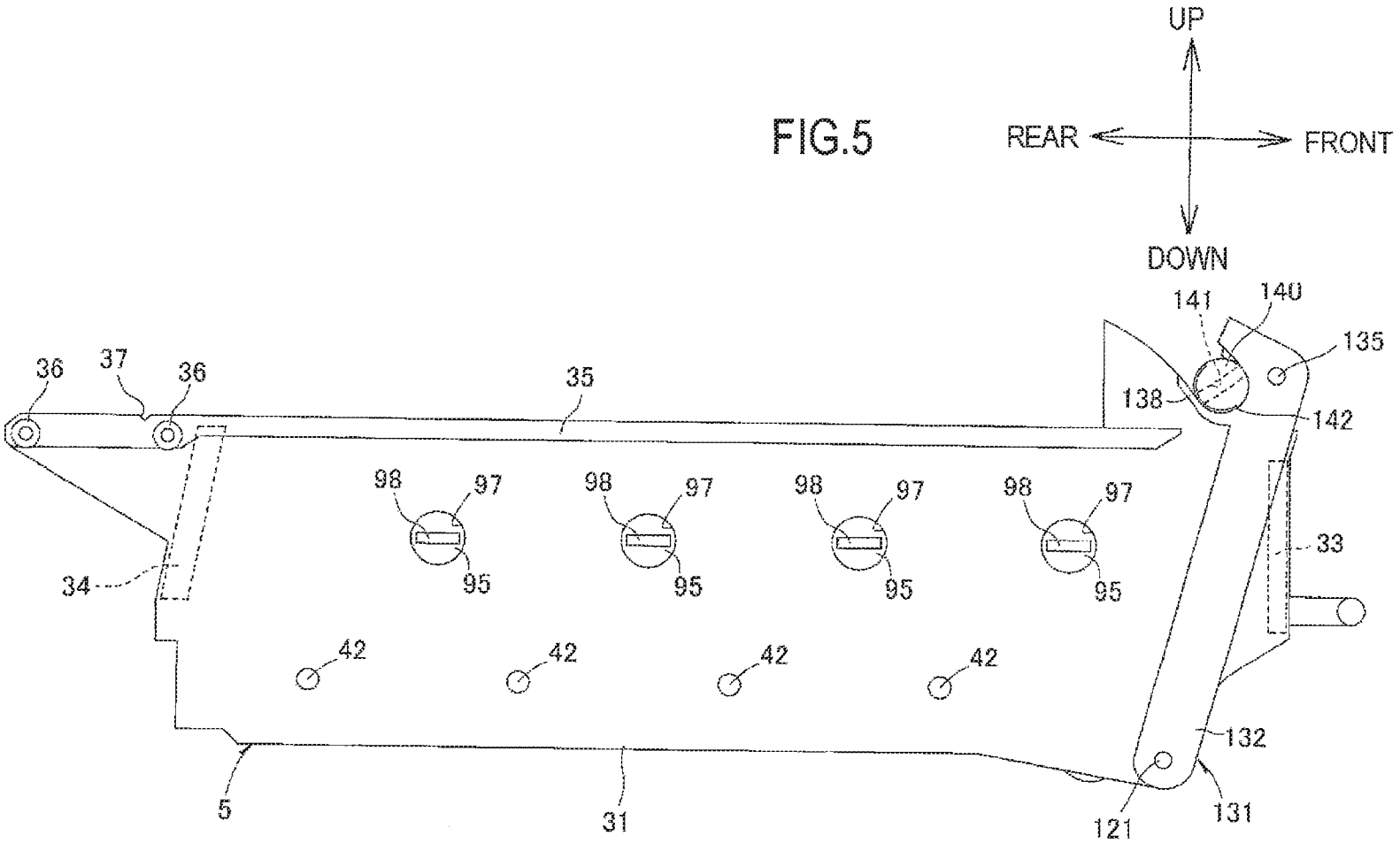
FIG. 5 is a left side view of the drawer unit, in which the operating knobs are aligned in the front-to-rear direction (the developing-unit-side shutters are in an open position)

As shown in FIGS. 4 through 7, an outer conveying unit 131 is provided on the left side surface of the left side plate 31. The outer conveying unit 131 has an elongated shape extending obliquely upward and forward from the lower front corner of the left side plate 31. The top end of the outer conveying unit 131 is disposed on the top edge of the left side plate 31. The outer conveying unit 131 is disposed further downstream than the downstream end of the guided part 35 in the direction that the drawer unit 5 is pulled outward. As shown in FIGS. 4 and 5, the outer conveying unit 131 overlaps a portion of the front beam 33 in the left-to-right direction.

As shown in FIGS. 4, 5, 6, and 7, the outer conveying unit 131 has an opposing wall 132 that opposes the left side plate 31 with a gap formed therebetween, and a peripheral wall 133 formed around the peripheral edges of the opposing wall 132. A space formed between the opposing wall 132 and the left side plate 31 is surrounded and enclosed by the peripheral wall 133 and serves as a waste toner conveying chamber 134.

The left end of the auger shaft 121 is rotatably supported in the bottom end of the opposing wall 132. A belt shaft 135 is rotatably supported in the top end of the opposing wall 132. The belt shaft 135 extends through the waste toner conveying chamber 134 in the left-to-right direction. A toner conveying belt 137 is looped around the portion of the auger shaft 121 disposed inside the waste toner conveying chamber 134, and the belt shaft 135. The toner conveying belt 137 has multiple protrusions 136 formed along its outer peripheral surface. The protrusions 136 are spaced at equal intervals in the circumferential direction of the toner conveying belt 137.

Figure 6:
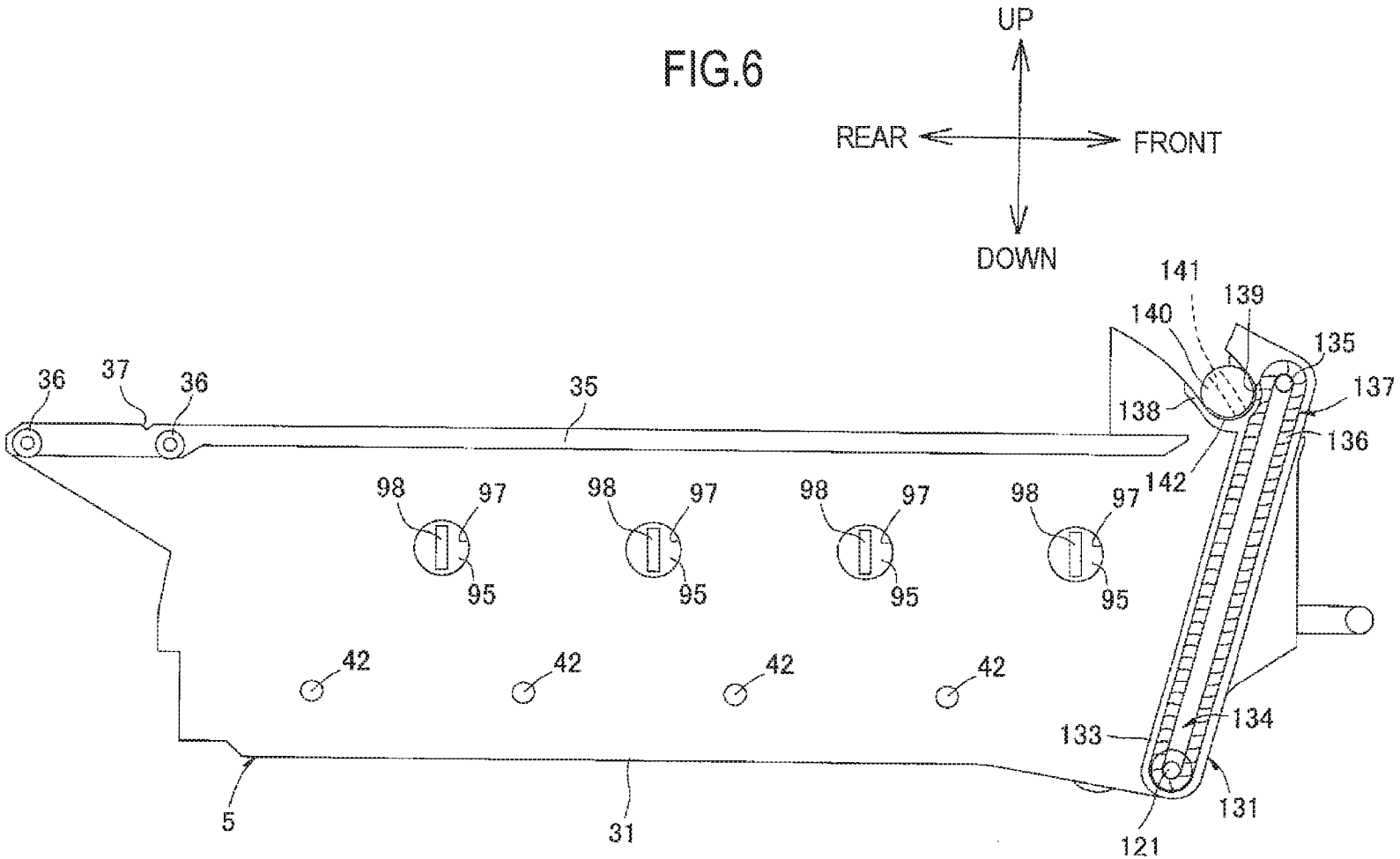
FIG. 6 is a left side view of the drawer unit, while showing a cross-section of an outer conveying unit, in which an outer shutter is in a closed position.
Figure 7:
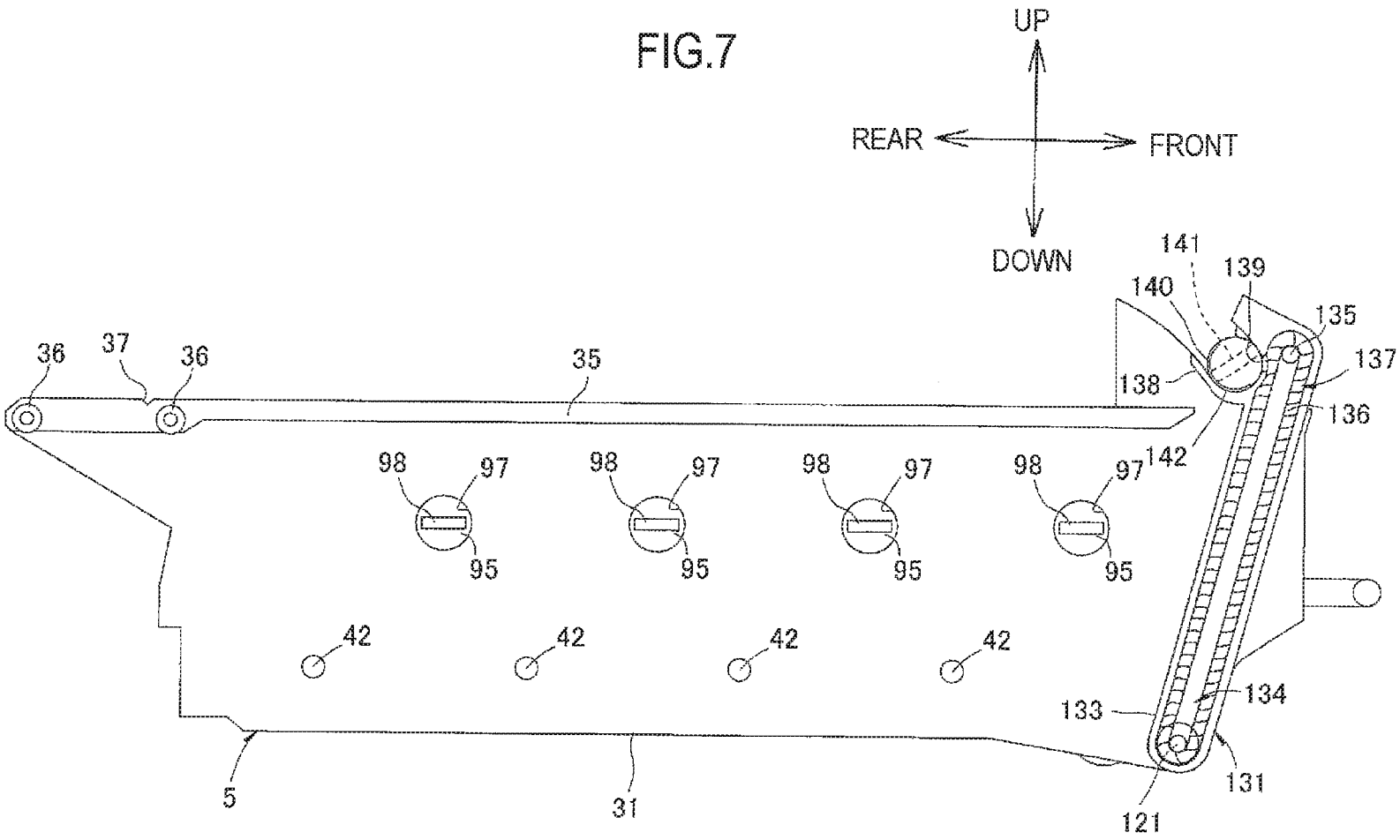
FIG. 7 is a left side view of the drawer unit, while showing the cross-section of the outer conveying unit, in which the outer shutter is in an open position.

A left side receiving part 138 is integrally formed with the peripheral wall 133 on the top end of the outer conveying unit 131 for receiving an upper conveying member 171 (described later) provided with the black toner unit 11 when the black toner unit 11 is mounted. The left side receiving part 138 is generally C-shaped in a side view, opening diagonally upward and rearward. As shown in FIGS. 6 and 7, a through-hole 139 is formed in the left side receiving part 138 and provides communication with the outside of the waste toner conveying chamber 134 (the space surrounded by the C-shape of the left side receiving part 138) and the interior of the waste toner conveying chamber 134.

A disc-shaped retaining member 140 is disposed in the space surrounded by the C-shape of the left side receiving part 138. The disc-shaped retaining member 140 is rotatably held by the left side receiving part 138. A third engagement groove 141 is formed in the inner surface of the disc-shaped retaining member 140. The third engagement groove 141 is a single groove extending diametrically through the disc-shaped retaining member 140 and is open in the circumferential edge of the same. An outer shutter 142 is coupled to the disc-shaped retaining member 140. The outer shutter 142 has a thin plate shape that curves to conform to the left side receiving part 138.

A right side receiving part 143 (see FIGS. 9, 10, and 26) is provided on the right side surface of the right side plate 32. The right side receiving part 143 has a general C-shape in a side view that opens diagonally upward and rearward.

3. Toner Unit

3-1. Black Toner Unit

As shown in FIGS. 15 through 18, the black toner unit 11 has a case 151. The case 151 has a larger font-to-rear dimension than a case 201 of the yellow, magenta, and cyan toner units 11 described later.

Figure 17:
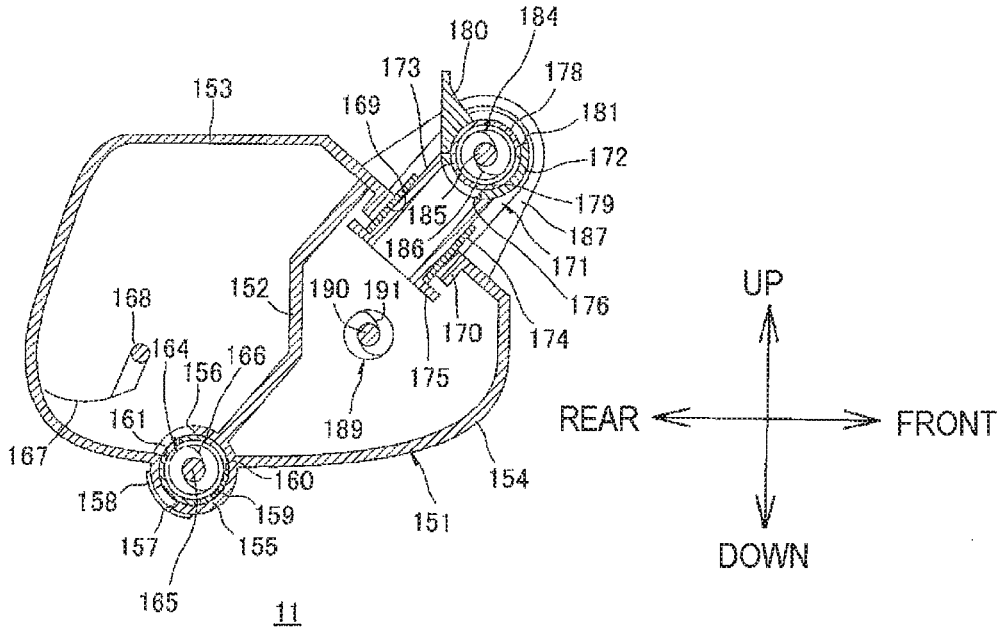
FIG. 17 is a cross-sectional view of the black toner unit, in which the operating lever extends upward, an inner cylindrical body is in a closed position, and a cylindrical shutter is in a closed position.
Figure 18:
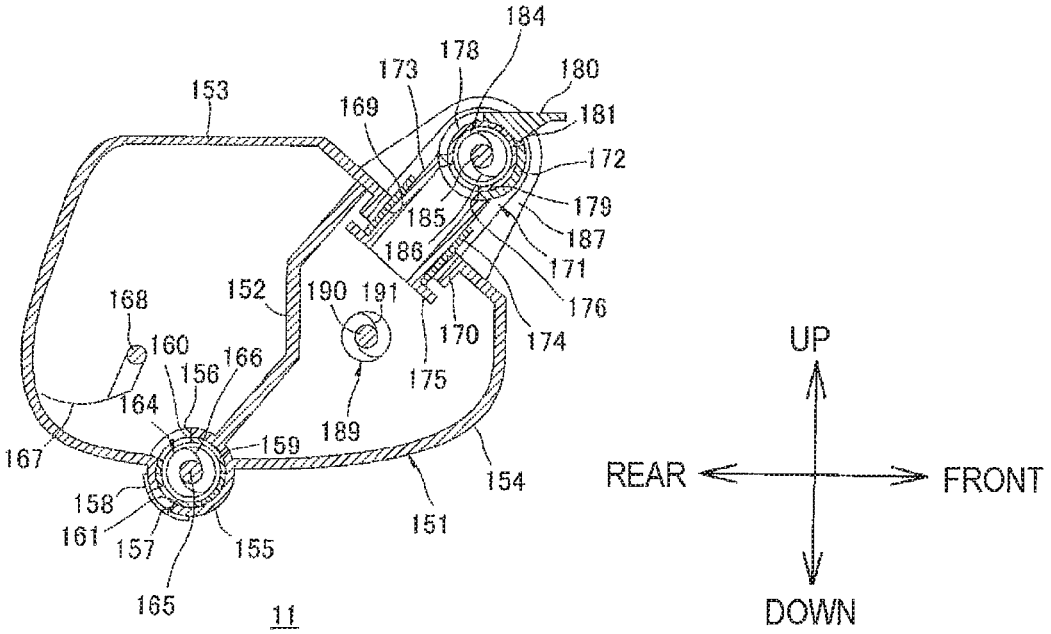
FIG. 18 is a cross-sectional view of the black toner unit, in which the operating lever extends forward, the inner cylindrical body is in an open position, and the cylindrical shutter is in an open position.

As shown in FIGS. 17 and 18, a partitioning wall 152 is formed in the case 151. The partitioning wall 152 divides the interior space of the case 151 into a rear space and a front space. The space formed on the rear side of the partitioning wall 152 serves to accommodate toner that is supplied to the developing unit 8. The portion of the case 151 defining the space on the rear side of the partitioning wall 152 will be referred to as a toner accommodating part 153. The space on the front side of the partitioning wall 152 serves to accommodate disposed toner (waste toner). The portion of the case 151 defining the space on the front side of the partitioning wall 152 will be referred to as a waste toner accommodating part 154. Hence, the case 151 is integrally provided with the toner accommodating part 153 and waste toner accommodating part 154.

An outer cylindrical body 155 having a circular cross section is integrally formed on the bottom edge of the case 151. A first outer-body-side supply through-hole 156 is formed in a portion of the outer cylindrical body 155 confronting the toner accommodating part 153. Second outer-body-side supply through-holes 157 are formed in the left to right center and both left and right ends of the outer cylindrical body 155 in regions facing externally. A sealing material 158 is provided on the outer peripheral surface of the outer cylindrical body 155 surrounding the circumference of the second outer-body-side supply through-holes 157.

An inner cylindrical body 159 having a circular cross section is rotatably provided on the inside of the outer cylindrical body 155 in a state in contact with the inner peripheral surface of the outer cylindrical body 155. A first inner-body-side supply through-hole 160 is formed in the inner cylindrical body 159 at a position opposing the first outer-body-side supply through-hole 156. Second inner-body-side supply through-holes 161 are formed in the inner cylindrical body 159 at positions opposing the second outer-body-side supply through-holes 157. The first inner-body-side supply through-hole 160 is identical in shape to the first outer-body-side supply through-hole 156. The second inner-body-side supply through-holes 161 are identical in shape to the second outer-body-side supply through-holes 157.

Figure 15:
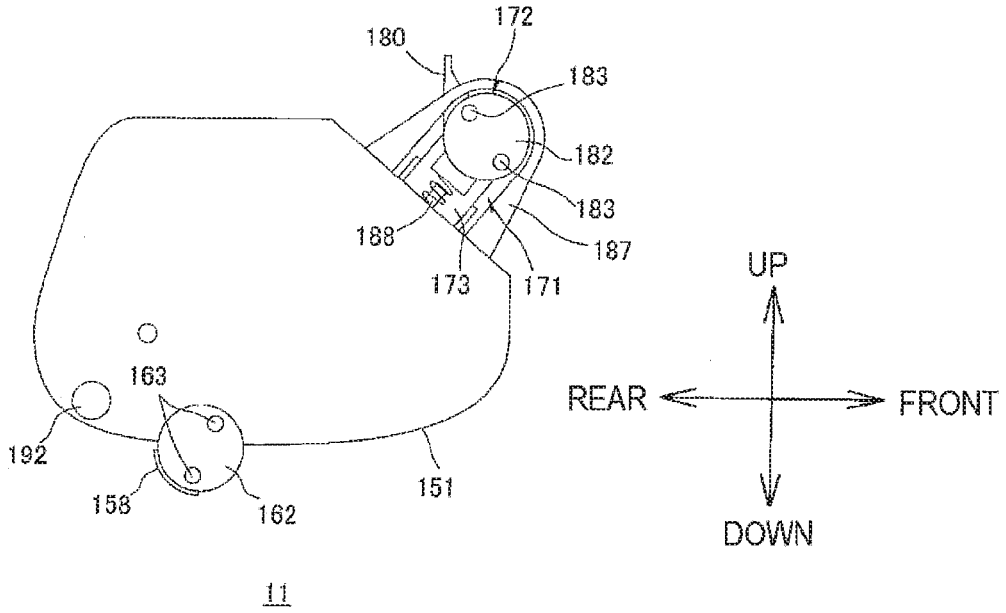
FIG. 15 is a left-side view of a black toner unit, in which an operating lever extends upward.
Figure 16:
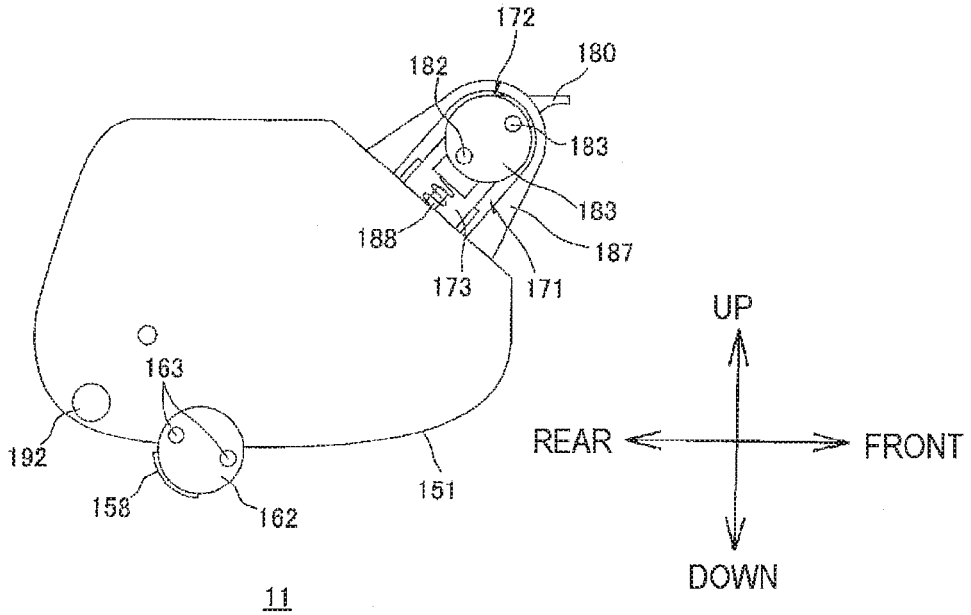
FIG. 16 is a left-side view of the black toner unit, in which the operating lever extends forward.

As shown in FIGS. 15 and 16, a disc-shaped left enclosing plate 162 is provided on the left end of the outer cylindrical body 155 and inner cylindrical body 159. The left enclosing plate 162 closes off the left ends of both the outer cylindrical body 155 and inner cylindrical body 159. The left end of the inner cylindrical body 159 is fixed to the left enclosing plate 162. Two engaging bosses 163 are formed on the outer surface (left endface) of the left enclosing plate 162. The engaging bosses 163 are columnar-shaped and are disposed in diametrically opposed positions.

Figure 19:
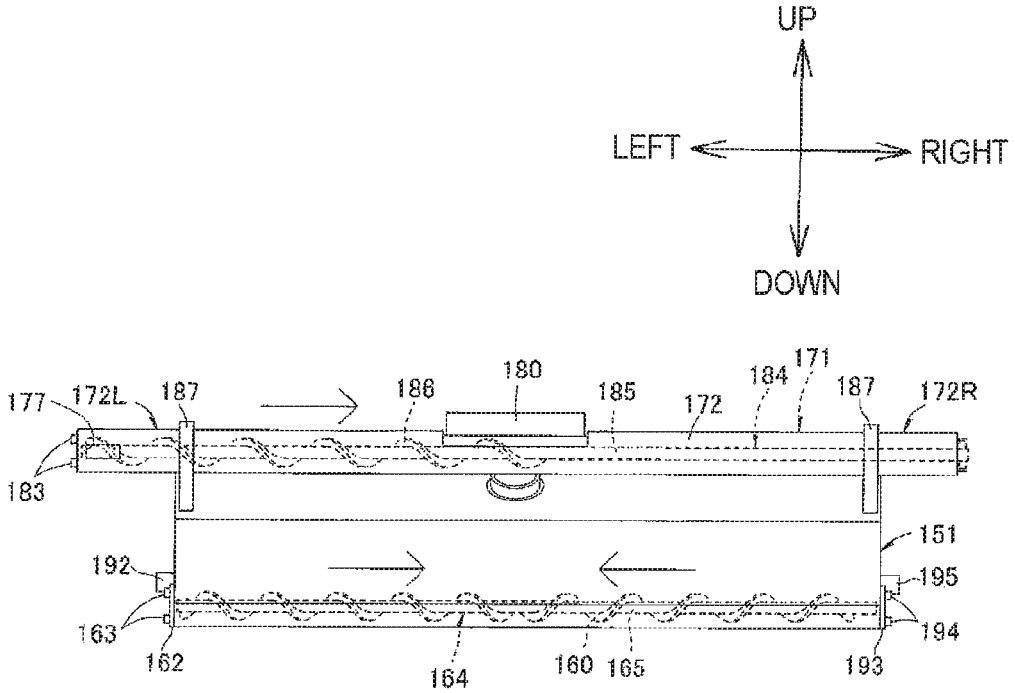
FIG. 19 is a front view of the black toner unit.

As shown in FIG. 19, a disc-shaped right enclosing plate 193 is provided on the right end of the outer cylindrical body 155 and inner cylindrical body 159. The right enclosing plate 193 closes off the right ends of both the outer cylindrical body 155 and inner cylindrical body 159. The right end of the inner cylindrical body 159 is fixed to the right enclosing plate 193. Through this structure, the inner cylindrical body 159, left enclosing plate 162, and right enclosing plate 193 are capable of rotating as a unit. Two engaging bosses 194 are formed on the outer surface (right endface) of the right enclosing plate 193. The engaging bosses 194 are columnar-shaped and disposed in two diametrically opposing positions.

As shown in FIGS. 17 and 18, an auger 164 is provided inside the inner cylindrical body 159. The auger 164 is configured of an auger shaft 165 oriented in the left-to-right direction, and an auger screw 166 formed in a helical shape around the circumference of the auger shaft 165. The left and right ends of the auger 164 are rotatably supported in the left enclosing plate 162 and right enclosing plate 193, respectively. As shown in FIG. 19, the portion of the auger screw 166 on the left half of the auger shaft 165 is wound in the direction opposite that on the right half.

As shown in FIGS. 17 and 18, an agitator 167 is provided inside the toner accommodating part 153. The agitator 167 is configured of a film and is affixed to an agitator shaft 168 extending in the left-to-right direction. The agitator shaft 168 is rotatably supported in the left and right side surfaces of the toner accommodating part 153 (the case 151).

As shown in FIGS. 17 and 18, a circular through-hole 169 is formed in the left-to-right center of the waste toner accommodating part 154 (the case 151) near the top edge of the partitioning wall 152. A piston guide part 170 is formed in the waste toner accommodating part 154. The piston guide part 170 has a flattened cylindrical shape and protrudes obliquely downward and rearward from the peripheral edge of the circular through-hole 169.

An upper conveying member 171 is provided on the upper front side of the case 151. The upper conveying member 171 includes a main body part 172 elongated in the left-to-right direction, and a connecting part 173 extending obliquely downward and rearward from the left-to-right center portion of the main body part 172.

As shown in FIGS. 17, 18, and 19, the main body part 172 has a cylindrical shape. As shown in FIG. 19, the main body part 172 is wider in the left-to-right direction than the left-to-right width of the case 151. Thus, left and right ends 172L and 172R of the main body part 172 protrude outward in the left-to-right direction from the respective left and right side surfaces of the case 151.

The connecting part 173 is cylindrical in shape with its central axis extending obliquely downward and rearward. The outer diameter of the connecting part 173 is slightly smaller than the inner diameter of the piston guide part 170. The connecting part 173 is inserted into the piston guide part 170. A cylindrical sealing member 174 is affixed to the outer peripheral surface of the connecting part 173 for sealing the gap between the inner peripheral surface of the piston guide part 170 and the outer peripheral surface of the connecting part 173. A flange 175 is formed on the lower rear end portion (distal end portion) of the connecting part 173, jutting radially outward from this end portion.

As shown in FIGS. 17 and 18, an internal communication through-hole 176 is formed in a portion of the main body part 172 confronting the interior of the connecting part 173. As shown in FIG. 19, a rectangular-shaped external communication through-hole 177 is formed in the left end portion of the main body part 172. The external communication through-hole 177 faces forward.

As shown in FIGS. 17 and 18, a cylindrical shutter 178 having a circular cross section is rotatably provided inside the main body part 172. The shutter 178 can rotate while contacting the inner peripheral surface of the main body part 172. An opening 179 identical in shape to the internal communication through-hole 176 formed in the main body part 172 is formed in the shutter 178 at the same left-to-right position as the internal communication through-hole 176. Another opening (not shown) identical in shape to the external communication through-hole 177 formed in the main body part 172 is also formed in the shutter 178 at the same left-to-right position as the external communication through-hole 177.

An operating lever 180 is provided on the left-to-right center region of the shutter 178. The operating lever 180 has a general triangular shape in a side view. The operating lever 180 is connected to the outer peripheral surface of the shutter 178 and is inserted through a lever insertion through-hole 181 formed in the main body part 172 so as to protrude out from the main body part 172. When the operating lever 180 is operated, the shutter 178 can be rotated between an open position in which the opening 179 and the other opening not shown in the drawings are in communication with the internal communication through-hole 176 and external communication through-hole 177 of the main body part 172, and a closed position in which the opening 179 and the other opening are closed by the shutter 178.

As shown in FIGS. 15 and 16, a disc-shaped left enclosing plate 182 is provided on the left end of the main body part 172 and shutter 178. The left enclosing plate 182 closes off the left ends of both the main body part 172 and shutter 178. The left end of the shutter 178 is fixed to the left enclosing plate 182. Two engaging bosses 183 are formed on the outer surface (left endface) of the left enclosing plate 182. The engaging bosses 183 are columnar-shaped and are disposed in diametrically opposed positions.

While not shown in the drawings, a right enclosing plate shaped symmetrically with the left enclosing plate 182 relative to the left-to-right direction is provided on the right ends of the main body part 172 and shutter 178. The right enclosing plate closes off the right ends of both the main body part 172 and shutter 178. The right end of the shutter 178 is fixed to the right enclosing plate. Through this structure, the shutter 178, left enclosing plate 182, and right enclosing plate are capable of rotating as a unit.

As shown in FIGS. 17 and 18, an auger 184 is provided inside the shutter 178. The auger 184 is configured of an auger shaft 185 oriented in the left-to-right direction, and an auger screw 186 formed in a helical shape around the circumference of the auger shaft 185. The auger 184 is rotatably supported in the left enclosing plate 182 and the right enclosing plate. As shown in FIG. 19, the auger screw 186 is formed only around the left half of the auger shaft 185.

As shown in FIGS. 15, 16, and 19, a toner-unit-side receiving part 187 is formed one on each of the left and right ends of the case 151. The toner-unit-side receiving parts 187 are U-shaped in a side view and, together with the case 151 (the waste toner accommodating part 154), surrounds the main body part 172. A spring 188 is interposed between the case 151 and main body part 172 within the region surrounded by each toner-unit-side receiving part 187 for urging the main body part 172 away from the case 151 (in a direction obliquely upward and forward).

As shown in FIGS. 17 and 18, an auger 189 is provided inside the waste toner accommodating part 154. The auger 189 is configured of an auger shaft 190 that extends in the left-to-right direction, and an auger screw 191 formed in a helical shape around the circumference of the auger shaft 190. The auger shaft 190 is rotatably supported in the left and right sides of the waste toner accommodating part 154 (the case 151).

As shown in FIGS. 15 and 16, a columnar-shaped guided boss 192 is provided on the left side surface of the case 151. Specifically, the guided boss 192 protrudes leftward from a region near the bottom rear corner of the case 151. Similarly, as shown in FIG. 19, a guided boss 195 is provided on the right surface of the case 151 and protrudes rightward therefrom. The guided boss 195 is also columnar-shaped with the same diameter as the guided boss 192 and is disposed in a position aligned with the guided boss 192 on the left side with respect to the left-to-right direction.

3-2. Toner Unit for Each of Yellow, Magenta, and Cyan

Figure 20:
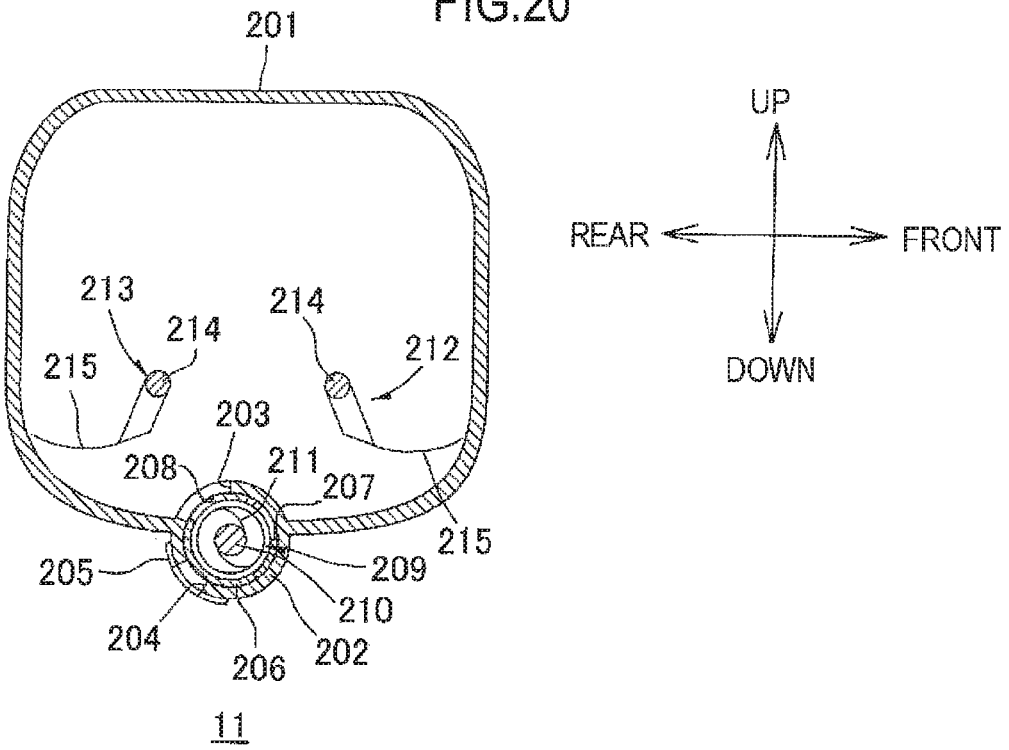
FIG. 20 is a cross-sectional view of a toner unit for yellow, magenta, or cyan, in which an inner cylindrical body is in a closed position.
Figure 21:
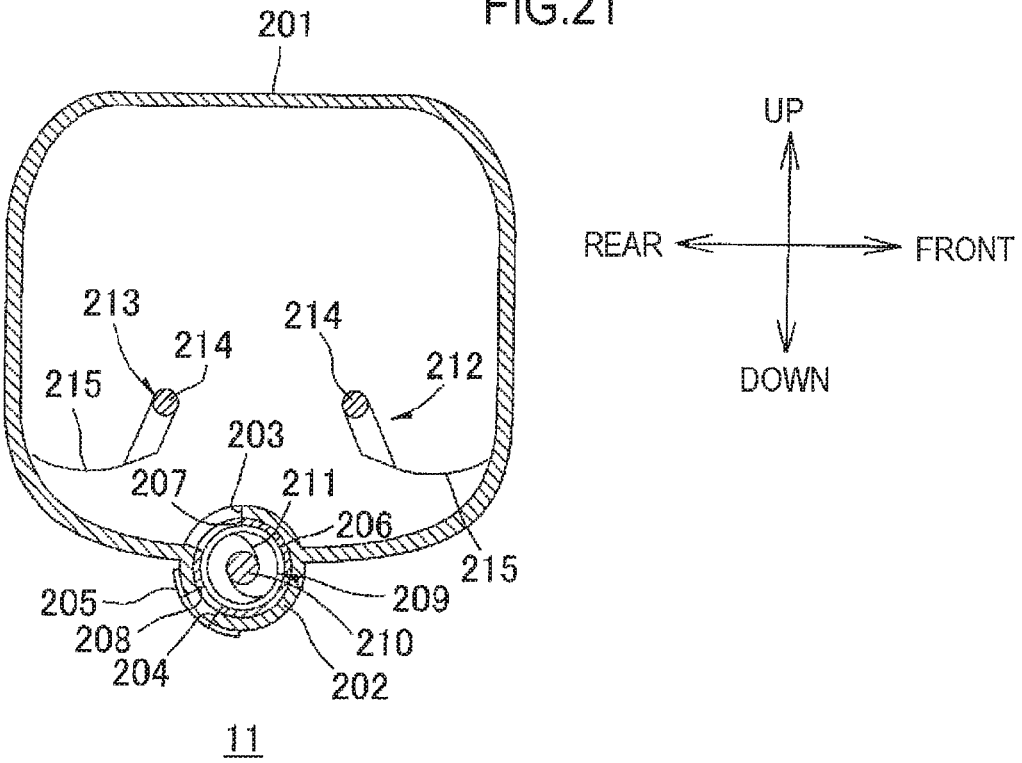
FIG. 21 is a cross-sectional view of the toner unit for yellow, magenta, or cyan, in which the inner cylindrical body is in an open position.

As shown in FIGS. 20 and 21, the toner unit 11 for each of yellow, cyan, and magenta has a case 201. Toner is accommodated in the case 201.

An outer cylindrical body 202 having a circular cross section is integrally formed on the bottom edge of the case 201. A first outer-body-side supply through-hole 203 is formed in a portion of the outer cylindrical body 202 confronting the inside of the case 201. Second outer-body-side supply through-holes 204 are formed in the left to right center and both left and right ends of the outer cylindrical body 202 in regions facing externally. A sealing material 205 is provided on the outer peripheral surface of the outer cylindrical body 202 surrounding the circumference of the second outer-body-side supply through-holes 204.

An inner cylindrical body 206 having a circular cross section is rotatably provided on the inside of the outer cylindrical body 202 in a state in contact with the inner peripheral surface of the outer cylindrical body 202. A first inner-body-side supply through-hole 207 is formed in the inner cylindrical body 206 at a position opposing the first outer-body-side supply through-hole 203. Second inner-body-side supply through-holes 208 are formed in the inner cylindrical body 206 at positions opposing the second outer-body-side supply through-holes 204. The first inner-body-side supply through-hole 207 is identical in shape to the first outer-body-side supply through-hole 203. The second inner-body-side supply through-holes 208 are identical in shape to the second outer-body-side supply through-holes 204.

Although not shown in the drawings, a disc-shaped left enclosing plate is provided on the left end of the outer cylindrical body 202 and inner cylindrical body 206. The left enclosing plate closes off the left ends of both the outer cylindrical body 202 and inner cylindrical body 206. The left end of the inner cylindrical body 206 is fixed to the left enclosing plate. Two engaging bosses are formed on the outer surface (left endface) of the left enclosing plate. The engaging bosses are columnar-shaped and are disposed in diametrically opposed positions. A disc-shaped right enclosing plate is provided on the right end of the outer cylindrical body 202 and inner cylindrical body 206. The right enclosing plate closes off the right ends of both the outer cylindrical body 202 and inner cylindrical body 206. The right end of the inner cylindrical body 206 is fixed to the right enclosing plate. Through this structure, the inner cylindrical body 206, left enclosing plate, and right enclosing plate are capable of rotating as a unit. Two engaging bosses are formed on the outer surface (right endface) of the right enclosing plate. The engaging bosses are columnar-shaped and disposed in two diametrically opposing positions.

An auger 209 is provided inside the inner cylindrical body 206. The auger 209 is configured of an auger shaft 210 oriented in the left-to-right direction, and an auger screw 211 formed in a helical shape around the circumference of the auger shaft 210. The left and right ends of the auger 209 are rotatably supported in the left enclosing plate and right enclosing plate, respectively.

Two agitators 212 and 213 are provided inside the case 201. The agitators 212 and 213 are juxtaposed in the front-to-rear direction. The agitators 212 and 213 have the same configuration with each other. That is, each of the agitators 212 and 213 is configured of an agitator shaft 214 extending in the left-to-right direction and an agitating film 215 held by the agitator shaft 214. The agitator shaft 214 is rotatably supported in the left and right side surfaces of the case 201.

Although not shown in the drawings, a columnar-shaped guided boss is provided on the left side surface of the case 201 to protrude leftward (outward) from a region near the bottom rear corner of the case 201. Similarly, a columnar-shaped guided boss is provided on the right side surface of the case 201 to protrude rightward (outward) from a region near the bottom rear corner of the case 201.

4. Mounting and Removing Toner Units

The toner units 11 are mounted into and removed from the drawer unit 3 when the front cover 4 has been opened and the drawer unit 3 has been pulled out of the main casing 2 to the pulled-out position, as shown in FIG. 3. The toner units 11 are mounted in and removed from the drawer unit 3 through the top of the corresponding mounting spaces 64 provided between the left and right side plates 62 of each developing unit 8.

When the toner units 11 have been removed from the drawer unit 3, the operating knobs 98 of all manual operating members 95 are aligned in the vertical direction, as shown in FIG. 4. Further, the second engagement grooves 96 of the manual operating members 95 and the coupling protrusions 83 of the shutter operating members 80 engaged in the respective second engagement grooves 96 are aligned in a slanted direction downward toward the front (or upward toward the rear), as shown in FIG. 10. The first engagement grooves 82 of the shutter operating members 80 are aligned vertically, as shown in FIG. 8. Further, the third engagement groove 141 of the disc-shaped retaining member 140 is aligned in a slanted direction downward and forward (or upward and rearward), as shown in FIG. 4.

As shown in FIG. 17, the operating lever 180 of the black toner unit 11 extends upward. In this state, the shutter 178 is in the closed position. That is, the shutter 178 opposes and closes the internal communication through-hole 176. The shutter 178 also opposes and closes the external communication through-hole 177 (see FIG. 19).

In order to mount a toner unit 11 in the corresponding mounting space 64, the user positions the toner unit 11 above the mounting space 64.

In the case of the black toner unit 11, as shown in FIG. 3, the user moves the toner unit 11 downward into the mounting space 64 so that the guided boss 192 and guided boss 195 (see FIG. 19) are introduced into the toner unit guide grooves 84 (see FIG. 8). As indicated by broken lines in FIG. 3, the user continues to move the toner unit 11 downward as the guided boss 192 and guided boss 195 are guided in the toner unit guide grooves 84. As the toner unit 11 continues its downward movement, the engaging bosses 163 and 194 (see FIG. 19) are introduced into the corresponding first engagement grooves 82 (see FIG. 8). Since the first engagement grooves 82 for the black developing unit 8 are slightly curved with their convex sides facing forward (see FIG. 8), the toner unit 11 rotates slightly clockwise in a left side view while moving downward. As a result of this rotation, the left and right ends 172L and 172R on the main body part 172 of the upper conveying member 171 are received by the left and right side receiving parts 138 and 143 (see FIGS. 6 and 26) while the engaging bosses 183 (see FIG. 15) are introduced into the third engagement groove 141 (see FIG. 6). When the guided bosses 192 and 195 (see FIGS. 15 and 19) arrive at the bottommost ends of the corresponding toner unit guide grooves 84, the toner unit 11 is restricted from moving farther downward.

Figure 22:
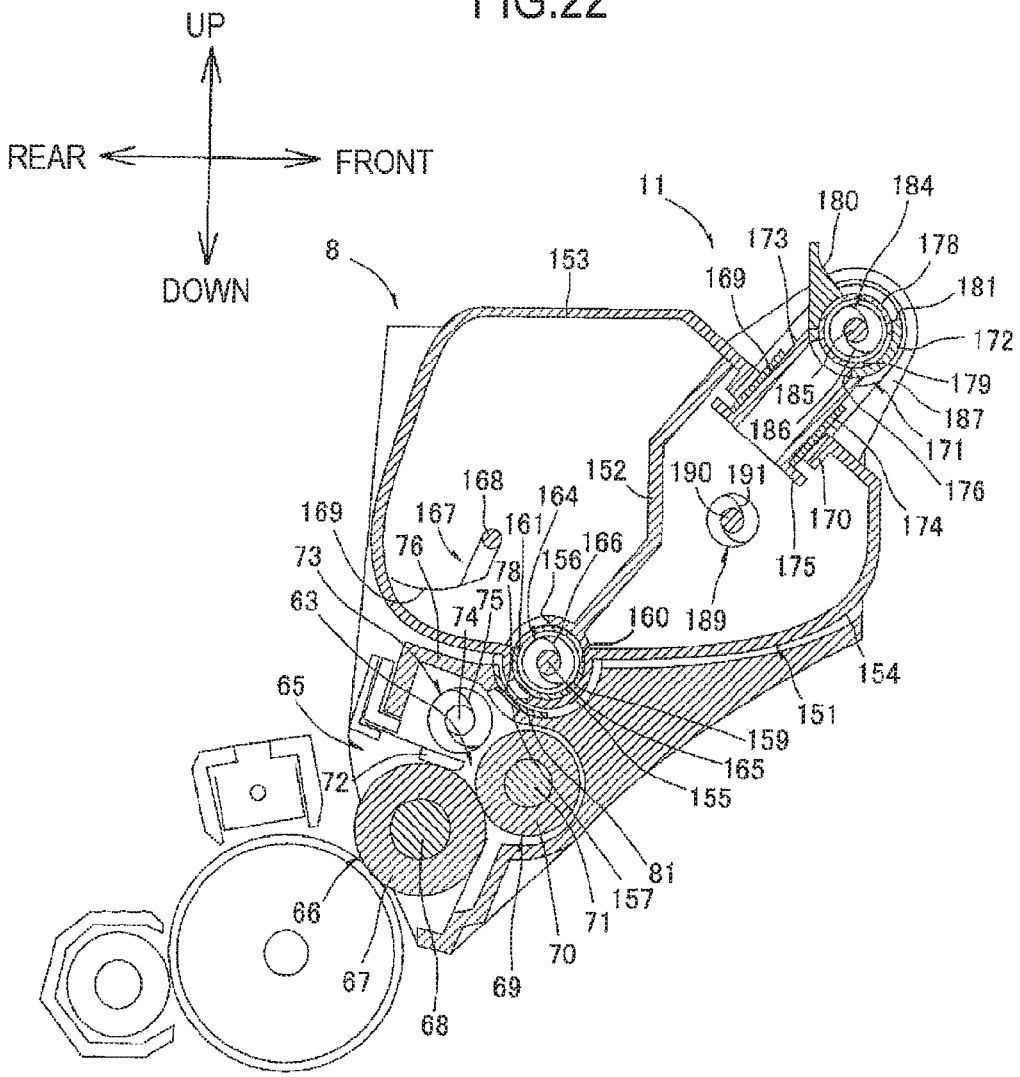
FIG. 22 is a cross-sectional view of the developing unit and the black toner unit, in which respective parts are in a closed position.

At this time, the developing-unit-side shutter 81 opposes and closes the through-holes 78, as shown in FIG. 22, and the inner cylindrical body 159 of the toner unit 11 is in the closed position. That is, the inner cylindrical body 159 opposes and closes the second outer-body-side supply through-holes 157. Further, the external communication through-hole 177 formed in the upper conveying member 171 (see FIG. 19) confronts the through-hole 139 of the outer conveying unit 131 (see FIG. 6) with the outer shutter 142 interposed therebetween. The shutter 178 also confronts the external communication through-hole 177.

Figure 23:
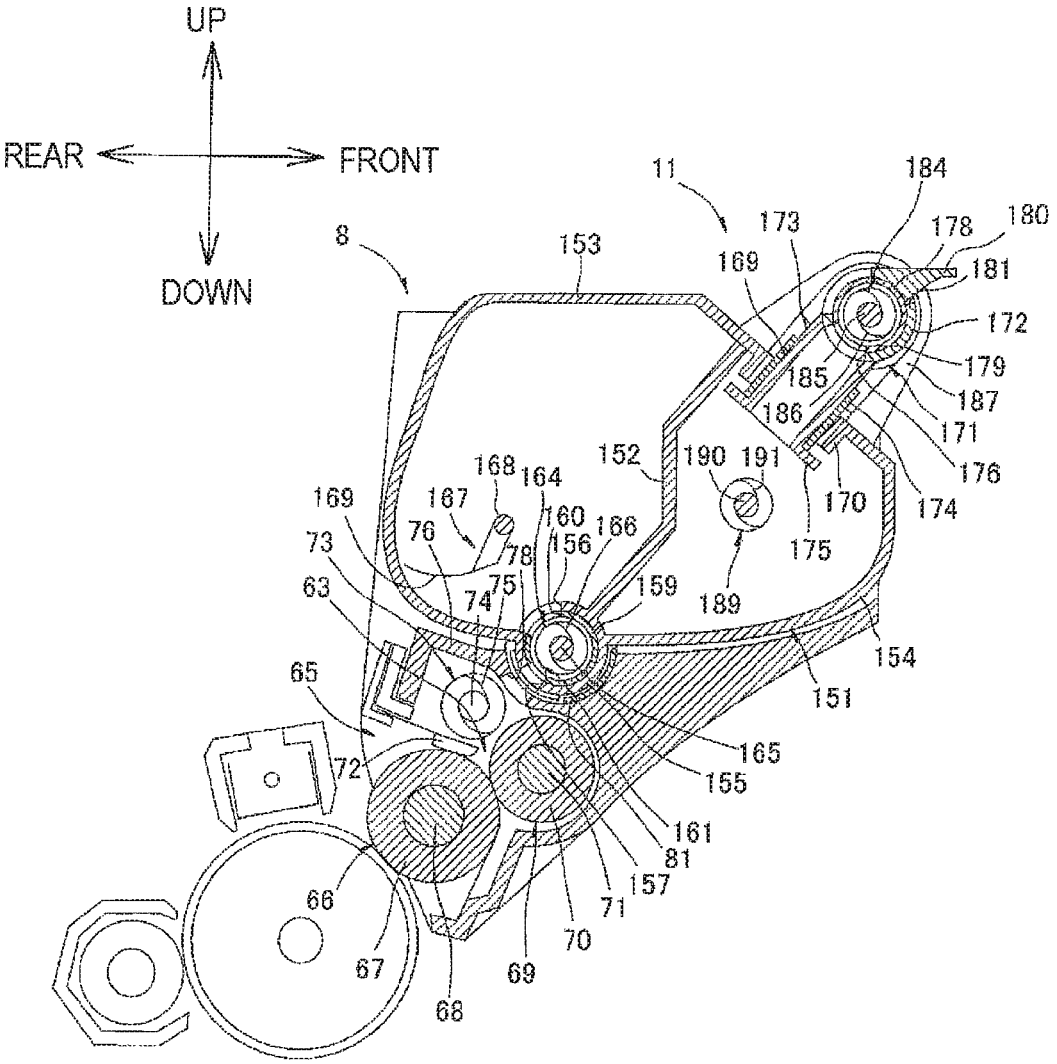
FIG. 23 is a cross-sectional view of the developing unit and the black toner unit, in which the respective parts are in an open position.

From this state, the user grips the operating knob 98 and rotates the manual operating member 95 approximately 90 degrees counterclockwise in a left side view until the operating knob 98 is aligned in the front-to-rear direction, as shown in FIG. 5. As the manual operating member 95 rotates, the shutter operating member 80 also rotates about 90 degrees counterclockwise in a left side view, moving the developing-unit-side shutter 81 to a position not confronting the through-holes 78, as shown in FIG. 9. Since the engaging bosses 163 and 194 (see FIGS. 15, 16, 19), which rotate together with the left and right enclosing plates 162 and 193, are engaged in the first engagement grooves 82 of the shutter operating member 80, the left and right enclosing plates 162 and 193 rotate about 90 degrees counterclockwise in a left side view, and the inner cylindrical body 159 rotates about 90 degrees counterclockwise together with the left and right enclosing plates 162 and 193. Through this operation, the inner cylindrical body 159 is moved to the open position so that the first inner-body-side supply through-hole 160 and second inner-body-side supply through-holes 161 formed in the inner cylindrical body 159 respectively oppose the first outer-body-side supply through-hole 156 and second outer-body-side supply through-holes 157, as shown in FIG. 23. As a result, the developing chamber 63 of the developing unit 8 is in communication with the interior of the toner accommodating part 153 in the toner unit 11 via the through-holes 78, second outer-body-side supply through-holes 157, second inner-body-side supply through-holes 161, internal space of the inner cylindrical body 159, first inner-body-side supply through-hole 160, and first outer-body-side supply through-hole 156.

In addition, the operator rotates the operating lever 180 about 90 degrees clockwise in a left side view until the operating lever 180 extends forward, as shown in FIG. 23. This operation rotates the shutter 178 from its closed position to the open position. Hence, the opening 179 and the other opening not shown in the drawings that are formed in the shutter 178 are now in communication with the internal communication through-hole 176 and external communication through-hole 177 of the main body part 172, respectively. Further, since the engaging bosses 183 (see FIGS. 15 and 16) that rotate together with the shutter 178 are engaged in the third engagement groove 141 of the disc-shaped retaining member 140 (see FIGS. 5 and 6), the disc-shaped retaining member 140 rotates together with the rotation of the shutter 178, and the outer shutter 142 is moved to a position not confronting the through-hole 139 (see FIGS. 4 and 5). As a result, the waste toner conveying chamber 134 in the outer conveying unit 131 is in communication with the interior of the shutter 178 via the through-hole 139 formed in the outer conveying unit 131, the external communication through-hole 177 formed in the main body part 172, and the opening (not shown) in the shutter 178. The interior of the shutter 178 is also in communication with the interior of the connecting part 173 via the opening 179 formed in the shutter 178 and the internal communication through-hole 176.

This completes the operation for mounting the black toner unit 11 in the corresponding mounting space 64.

In the case of the toner unit 11 for each of yellow, magenta, and cyan, the user moves the toner unit 11 downward into the mounting space 64 so that the guided bosses (not shown) are introduced into the toner unit guide grooves 84 (see FIG. 8). The user continues to move the toner unit 11 downward as the guided bosses are guided in the toner unit guide grooves 84. As the toner unit 11 continues its downward movement, the engaging bosses (not shown) are introduced into the corresponding first engagement grooves 82 (see FIG. 8). When the guided bosses arrive at the bottommost ends of the corresponding toner unit guide grooves 84, the toner unit 11 is restricted from moving farther downward.

Figure 24:
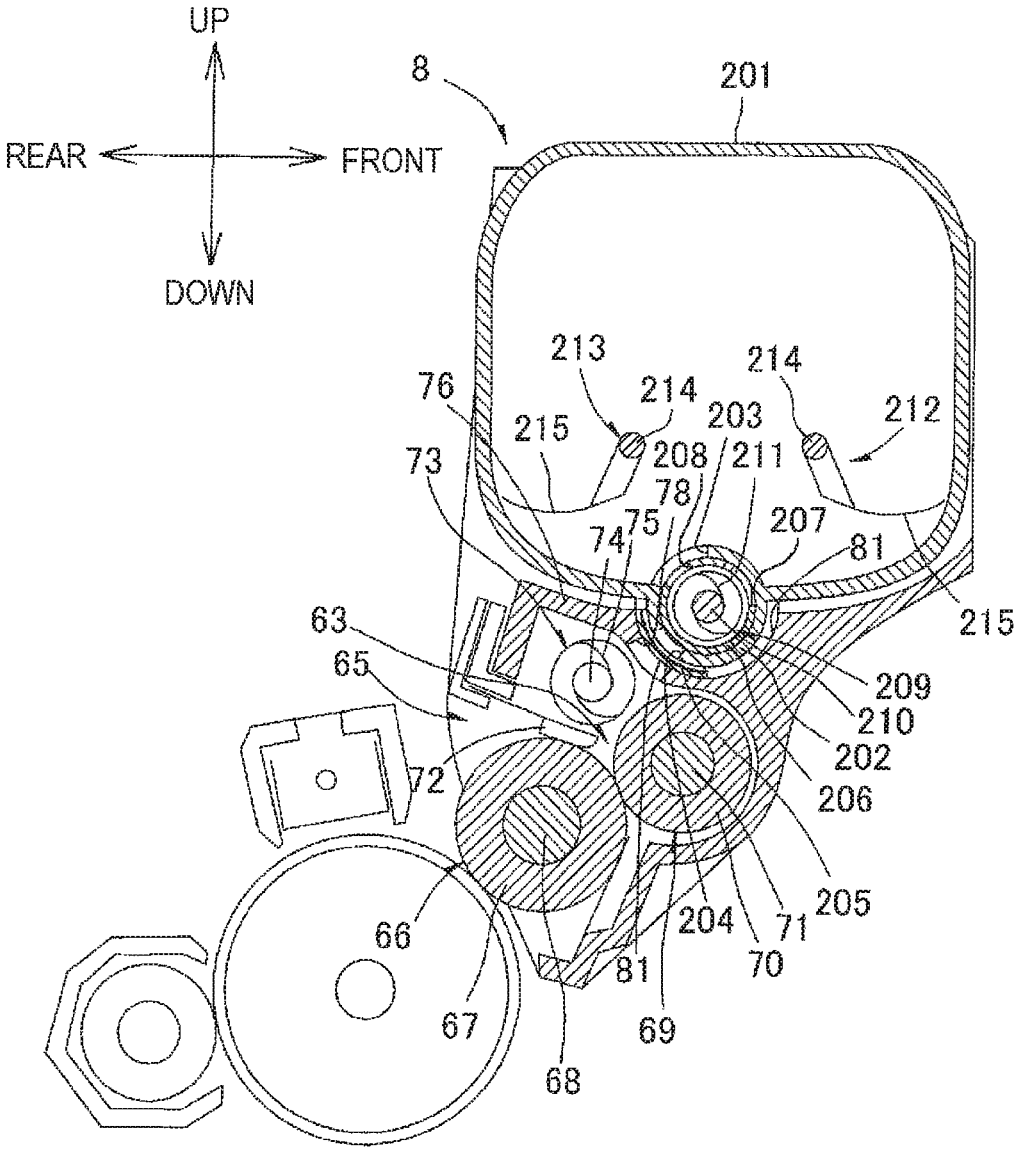
FIG. 24 is a cross-sectional view of the developing unit and the toner unit for yellow, magenta, or cyan, in which respective parts are in a closed position.

At this time, the developing-unit-side shutter 81 opposes and closes the through-holes 78, as shown in FIG. 24, and the inner cylindrical body 206 opposes and closes the second outer-body-side supply through-holes 204.

Figure 25:
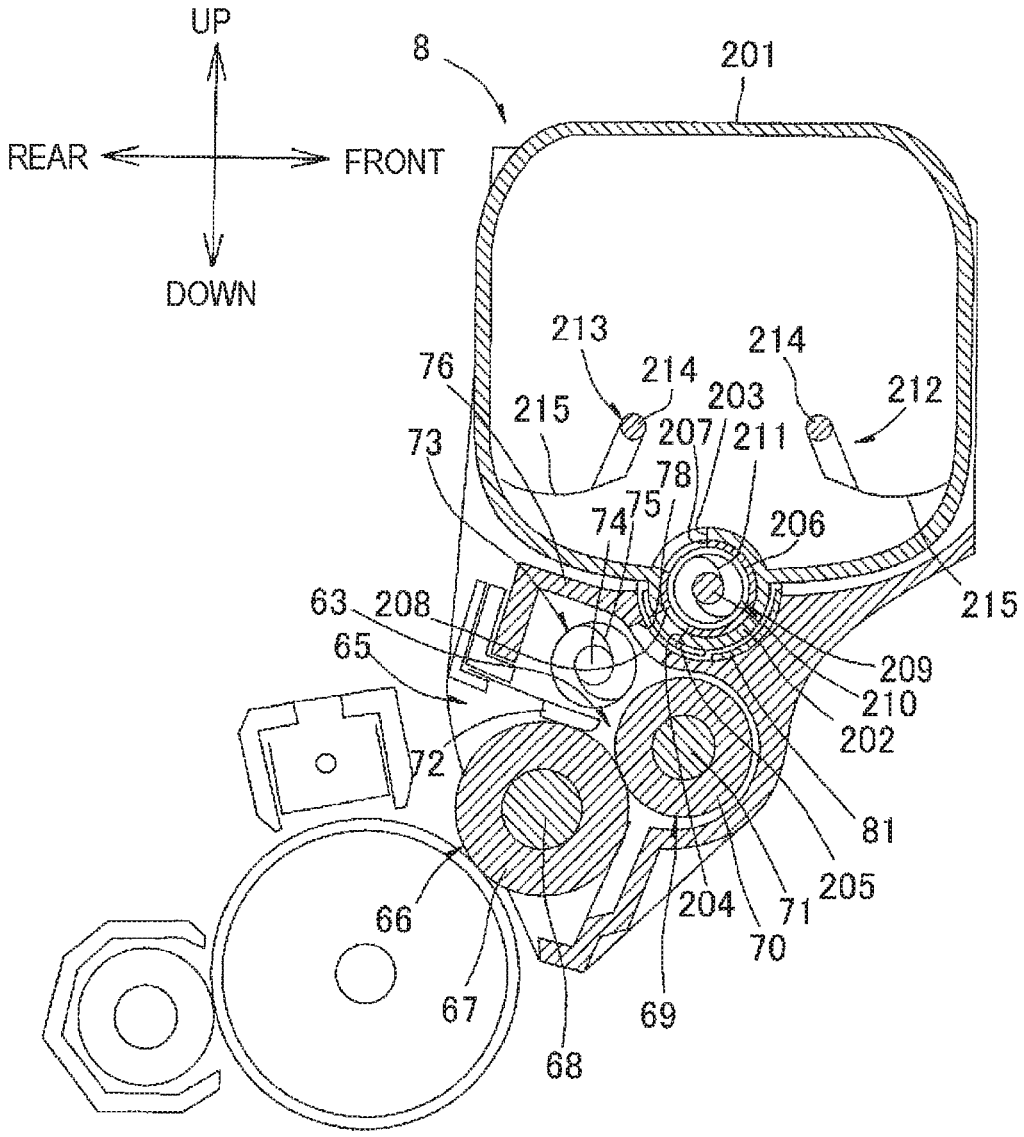
FIG. 25 is a cross-sectional view of the developing unit and the toner unit for yellow, magenta, or cyan, in which the respective parts are in an open position.

From this state, the user grips the operating knob 98 and rotates the manual operating member 95 approximately 90 degrees counterclockwise in a left side view until the operating knob 98 is aligned in the front-to-rear direction, as shown in FIG. 5. As the manual operating member 95 rotates, the shutter operating member 80 also rotates about 90 degrees counterclockwise in a left side view, moving the developing-unit-side shutter 81 to a position not confronting the through-holes 78, as shown in FIG. 9. The left and right enclosing plates rotate about 90 degrees counterclockwise in a left side view, and the inner cylindrical body 206 rotates about 90 degrees counterclockwise together with the left and right enclosing plates. Through this operation, the first inner-body-side supply through-hole 207 and second inner-body-side supply through-holes 208 formed in the inner cylindrical body 206 respectively oppose the first outer-body-side supply through-hole 203 and second outer-body-side supply through-holes 204, as shown in FIG. 25. As a result, the developing chamber 63 of the developing unit 8 is in communication with the interior of the case 201 of the toner unit 11 via the through-holes 78, second outer-body-side supply through-holes 204, second inner-body-side supply through-holes 208, internal space of the inner cylindrical body 206, first inner-body-side supply through-hole 207, and first outer-body-side supply through-hole 203.

This completes the operation for mounting the toner unit 11 for each of yellow, magenta, and cyan in the corresponding mounting space 64.

To remove a toner unit 11 from the corresponding mounting space 64, the operation for mounting the toner unit 11 in the mounting space 64 is performed in reverse.

5. Supplying Toner

After the toner units 11 are mounted in the corresponding mounting spaces 64, the drawer unit 3 is inserted to the accommodated position inside the main casing 2 and the front cover 4 is closed. At this time, the toner units 11 begin supplying toner into the corresponding developing units 8.

In the black toner unit 11, the auger 164 and agitator 167 are rotated. The rotating agitator 167 supplies toner from the toner accommodating part 153 in the toner unit 11 into the inner cylindrical body 159. The rotating auger 164 conveys toner received in the inner cylindrical body 159 toward the center of the inner cylindrical body 159 in left and right directions so that the toner is supplied into the developing chamber 63 of the developing unit 8 primarily through the center second inner-body-side supply through-hole 161 and center second outer-body-side supply through-hole 157.

In the toner unit 11 for each of yellow, magenta, and cyan, the auger 209 and agitators 212 and 213 are rotated. The rotating agitators 212 and 213 supply toner from the case 201 of the toner unit 11 into the inner cylindrical body 206. The rotating auger 209 conveys toner received in the inner cylindrical body 206 toward the center of the inner cylindrical body 206 in left and right directions so that the toner is supplied into the developing chamber 63 of the developing unit 8 primarily through the center second inner-body-side supply through-hole 208 and center second outer-body-side supply through-hole 204.

Toner supplied into the developing chamber 63 is conveyed in left and right directions by the rotating auger 73 so as to be distributed. The rotating supply roller 69 supplies toner from the supply roller 69 (the main supply roller body 70) to the developing roller 66 (the main developing roller body 67). The rotating developing roller 66 then conveys toner supplied thereon under the free end of the thickness-regulating blade 72. The thickness-regulating blade 72 regulates the thickness of the toner carried on the developing roller 66 to a thin layer. During image formation, the peripheral surface of the developing roller 66 (the main developing roller body 67) is in contact with the surface of the photosensitive drum 6. Accordingly, toner carried on the developing roller 66 is supplied to the photosensitive drum 6 to develop a latent image formed on the surface of the photosensitive drum 6 into a toner image.

6. Recovering Waste Toner

Sometimes not all of the toner is transferred from the photosensitive drum 6 to the paper but remains on the surface of the photosensitive drum 6. During image formation, a cleaning bias is supplied to the drum cleaning roller 102 of each drum cleaner 9. The application of a cleaning bias cause residual toner (waste toner) on the surface of the photosensitive drum 6 to be attracted to and temporarily retained on the drum cleaning roller 102. Following completion of the image-forming operation and prior to a succeeding image-forming operation, a bias of opposite polarity to the cleaning bias is supplied to the drum cleaning rollers 102 so that the waste toner retained on the drum cleaning roller 102 is returned to the surface of the corresponding photosensitive drum 6. Next, a bias is supplied to the transfer roller 16 so that the waste toner returned to the surface of the photosensitive drum 6 is attracted to the sheet-conveying belt 13.

Toner is also sometimes transferred from the photosensitive drum 6 to the sheet-conveying belt 13 during an image-forming operation.

Waste toner transferred to the sheet-conveying belt 13 is recovered by the belt cleaner 10. Specifically, a first cleaning bias and a second cleaning bias are respectively supplied to the primary belt cleaning roller 111 and secondary belt cleaning roller 112. When waste toner on the sheet-conveying belt 13 moves opposite the primary belt cleaning roller 111, the toner is attracted to the primary belt cleaning roller 111. The waste toner transferred onto the primary belt cleaning roller 111 is subsequently attracted to the secondary belt cleaning roller 112. When the waste toner carried on the secondary belt cleaning roller 112 rotates against the scraper 119, the waste toner is scraped off the secondary belt cleaning miller 112 by the scraper 119 and falls into the waste toner conveying chamber 117.

Figure 26:
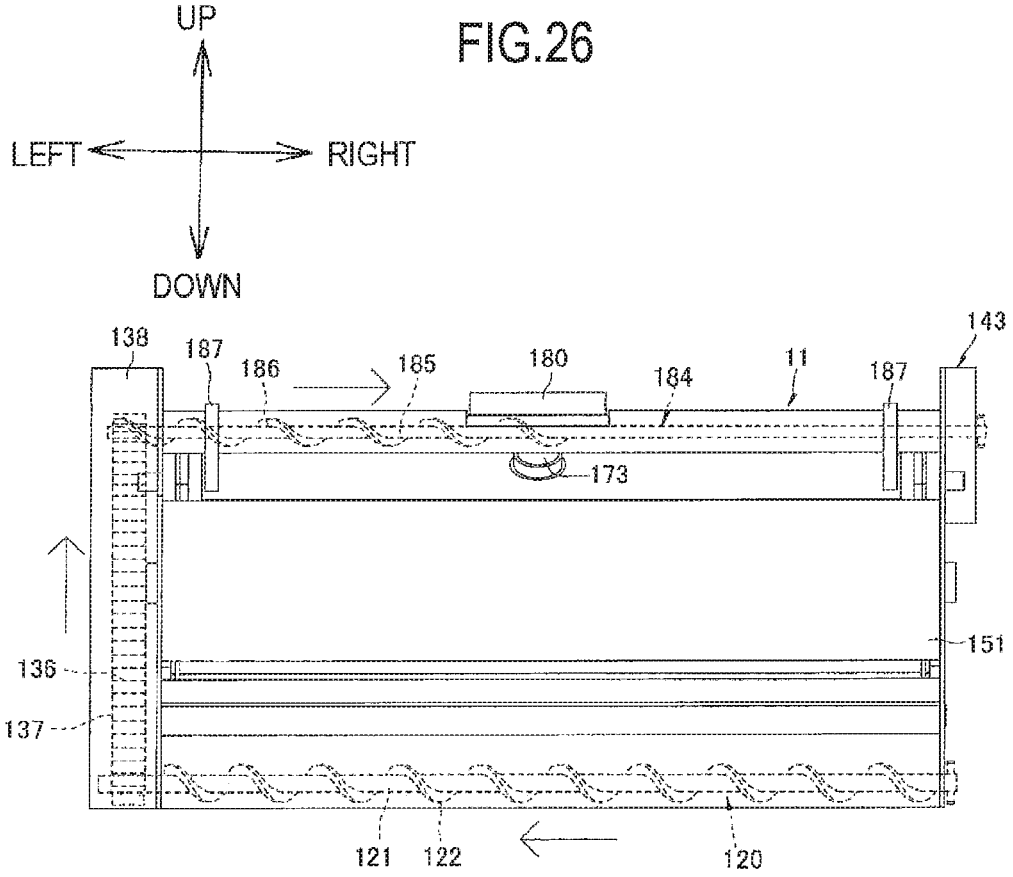
FIG. 26 is a front view of the black toner unit and the belt cleaner.

The auger 120 rotates within the waste toner conveying chamber 117. As shown in FIG. 26, the auger 120 conveys waste toner in the waste toner conveying chamber 117 leftward to the waste toner conveying chamber 134 of the outer conveying unit 131.

The toner conveying belt 137 circulates (rotates) within the waste toner conveying chamber 134. More specifically, the auger shaft 121 and the belt shaft 135 are driven to rotate in synchronization with each other to circulate the toner conveying belt 137. Accordingly, waste toner conveyed to the waste toner conveying chamber 134 is carried upward by the protrusions 136 formed on the toner conveying belt 137 as the toner conveying belt 137 circulates. The waste toner carried to the upper end of the waste toner conveying chamber 134 passes sequentially through the through-hole 139 formed in the outer conveying unit 131, the external communication through-hole 177 formed in the main body part 172 of the upper conveying member 171, and the opening (not shown) in the shutter 178 and flows into the shutter 178.

The auger 184 is rotating inside the shutter 178 and conveys waste toner in the shutter 178 toward the center of the shutter 178 in the left-to-right direction. Waste toner conveyed to the center of the shutter 178 flows into the connecting part 173 through the opening 179 formed in the shutter 178 and the internal communication through-hole 176 formed in the main body part 172. This waste toner passes through the connecting part 173 and is collected in the waste toner accommodating part 154. The rotating auger 189 disposed in the waste toner accommodating part 154 conveys waste toner introduced into the waste toner accommodating part 154 toward both left and right sides.

7. Operations (7-1) As described above, the color printer 1 is provided with the endless sheet-conveying belt 13. The sheet-conveying belt 13 is arranged to confront all four of the photosensitive drums 6 at the same time. The color printer 1 is also provided with the belt cleaner 10 and the waste toner accommodating part 154. The belt cleaner 10 removes toner to be discarded from the sheet-conveying belt 13 and collects this toner. A mechanism for conveying waste toner is connected to the belt cleaner 10 and waste toner accommodating part 154 and includes the auger 120, outer conveying unit 131, and upper conveying member 171. This waste toner conveying mechanism conveys waste toner collected by the belt cleaner 10 from the belt cleaner 10 to the waste toner accommodating part 154. The waste toner accommodating part 154 is integrated with the toner accommodating part 153 of the black toner unit 11. The developing roller 66 provided in the black developing unit 8 supplies toner accommodated in the toner accommodating part 153 to the corresponding photosensitive drum 6.

The upper conveying member 171 extends in the left-to-right direction, that is, in the axial direction of the photosensitive drum 6, and is coupled to the waste toner accommodating part 154 in such a manner that the upper conveying member 171 is movable relative to the waste toner accommodating part 154. Accordingly, while the position of the upper conveying member 171 is fixed relative to the photosensitive drum 6, the toner accommodating part 153 and waste toner accommodating part 154 can be moved integrally with each other, thereby moving the developing roller 66 relative to the photosensitive drum 6.

The upper conveying member 171 is disposed outside the waste toner accommodating part 154 and is capable of moving relative to the same. Accordingly, the toner accommodating part 153 and waste toner accommodating part 154 can be moved in a direction for separating the developing roller 66 from the photosensitive drum 6 while the position of the upper conveying member 171 is fixed relative to the photosensitive drum 6. The upper conveying member 171 can move relative to the waste toner accommodating part 154 between a position (receiving-part contact position) where the upper conveying member 171 contacts the toner-unit-side receiving parts 187 and another position ((receiving-part non-contact position) where the upper conveying member 171 separates from the toner-unit-side receiving parts 187. As the upper conveying member 171 moves relative to the waste toner accommodating part 154 from the receiving-part contact position to the receiving-part non-contact position against the urging force of the springs 188, the upper conveying member 171 moves in a direction toward the waste toner accommodating part 154. It is noted that when the black toner unit 11 is removed from the drawer frame 5, the upper conveying member 171 moves in a direction away from the waste toner accommodating part 154 due to the urging force of the springs 188, and finally contacts the toner-unit-side receiving parts 187. So, the toner-unit-side receiving parts 187 receive the urging force of the springs 188 via the upper conveying member 171. This construction can hold the upper conveying member 171 in a stable state (orientation) when the black toner unit 11 is removed from the drawer frame 5.

The upper conveying member 171 is disposed outside the waste toner accommodating part 154. So, when the toner accommodating part 153 and waste toner accommodating part 154 are moved, the waste toner accommodating part 154 will not catch on the upper conveying member 171, or no large amount of friction will be generated between the upper conveying member 171 and the waste toner accommodating part 154. The upper conveying member 171 will not inhibit the movement of the toner accommodating part 153 and waste toner accommodating part 154. So, the developing roller 66 can follow oscillations by the photosensitive drum 6 to maintain an optimum positional relationship with the photosensitive drum 6 for developing operations.

(7-2) The outer conveying unit 131 is provided on the left side of the left side plate 31. The auger 120 conveys waste toner collected by the belt cleaner 10 leftward. The outer conveying unit 131 conveys waste toner received from the auger 120 in a direction intersecting the left-to-right direction, and specifically diagonally upward and forward. The upper conveying member 171 conveys the waste toner received from the outer conveying unit 131 toward the waste toner accommodating part 154. Accordingly, the auger 120, outer conveying unit 131, and upper conveying member 171 can convey waste toner collected by the belt cleaner 10 to the waste toner accommodating part 154.

With this construction, a mechanism for conveying waste toner can be provided apart from the photosensitive drums 6, developing units 8, and the like.

(7-3) The toner accommodating part 153, waste toner accommodating part 154, and upper conveying member 171 are configured as a single toner unit 11 that can be mounted in and removed from the drawer frame 5 that holds the photosensitive drums 6. With this configuration, the toner accommodating part 153, waste toner accommodating part 154, and upper conveying member 171 can be attached to and detached from the drawer frame 5 as an integral unit.

(7-4) The main body part 172 of the upper conveying member 171 has the left and right ends 172L and 172R, both of which protrude farther outward in the left and right directions than the case 151 of the toner unit 11. The outer conveying unit 131 is connected to the left end 172L of the main body part 172 protruding on the left side of the case 151. This configuration prevents the case 151 from getting in the way of the connection between the outer conveying unit 131 and upper conveying member 171, enabling a suitable connection to be made therebetween.

The left side receiving part 138 and right side receiving part 143 are fixed relative to the drawer frame 5. When the toner unit 11 is mounted in the drawer frame 5, the left and right ends 172L and 172R of the main body part 172 constituting the upper conveying member 171 are held in the left and right side receiving parts 138 and 143, thereby securely fixing the position of the upper conveying member 171 relative to the photosensitive drum 6 while preventing the upper conveying member 171 from being inclined relative to the axial direction (left-to-right direction).

By retaining the left and right ends 172L and 172R of the main body part 172 in the left and right side receiving parts 138 and 143, respectively, the springs 188 can apply a balanced urging force to the left and right sides of the toner unit 11, ensuring that the developing roller 66 contacts the photosensitive drum 6 with good left-to-right balance.

(7-5) The external communication through-hole 177 formed in the left end 172L of the main body part 172 communicates with the outer conveying unit 131. The upper conveying member 171 is provided with the shutter 178 for opening and closing the external communication through-hole 177. Therefore, the external communication through-hole 177 can be closed by the shutter 178 when the outer conveying unit 131 is separated from the upper conveying member 171, preventing waste toner from leaking out of the external communication through-hole 177. When the outer conveying unit 131 is connected to the upper conveying member 171, on the other hand, the external communication through-hole 177 is opened to allow waste toner to be conveyed from the outer conveying unit 131 into the upper conveying member 171 via the external communication through-hole 177.

(7-6) The upper conveying member 171 has the main body part 172 and the connecting part 173. The main body part 172 is cylindrically shaped with its central axis oriented in the left-to-right direction. The connecting part 173 extends from the main body part 172 in a direction orthogonal to the left-to-right direction and connects to the waste toner accommodating part 154. Waste toner in the outer conveying unit 131 is conveyed sequentially through the main body part 172 and connecting part 173 and is collected in the waste toner accommodating part 154.

(7-7) The connecting part 173 is connected to the left-to-right center region of the waste toner accommodating part 154, preventing waste toner from collecting too much on one of the left and right sides of the waste toner accommodating part 154. Therefore, this construction can prevent the weight of the waste toner accommodating part 154 from becoming unbalanced left-to-right, enabling the developing roller 66 to confront the photosensitive drum 6 with good left-to-right balance.

Since the connecting part 173 is connected to a portion of the waste toner accommodating part 154 in the left-to-right center thereof, there is no concern that friction generated by the connecting part 173 when the developing roller 66 is repeatedly separated from and placed in contact with the photosensitive drum 6 will influence the left-to-right balance with which the developing roller 66 contacts the photosensitive drum 6.

While sliding between the connecting part 173 and waste toner accommodating part 154 can generate friction, the force of friction is applied uniformly to the toner unit 11, developing roller 66, and the like with respect to the left-to-right direction. Hence, a moment for rotating the toner unit 11 is not produced, thereby maintaining a stable positional relationship between the developing roller 66 and photosensitive drum 6 with respect to the left-to-right direction.

(7-8) The connecting part 173 is connected to the waste toner accommodating part 154 so as to be capable of moving relative to the same. Accordingly, the connecting part 173 moves relative to the waste toner accommodating part 154 as the toner accommodating part 153 and waste toner accommodating part 154 move, maintaining the connection between the connecting part 173 and waste toner accommodating part 154.

Hence, when the black toner unit 11 is configured by integrating the waste toner accommodating part 154 and toner accommodating part 153, the connection between the waste toner accommodating part 154 and upper conveying member 171 can be maintained while allowing the integrated toner accommodating part 153 and waste toner accommodating part 154 to move.

(7-9) The piston guide part 170 is formed in the waste toner accommodating part 154. The piston guide part 170 has a cylindrical shape with its central axis extending orthogonal to the left-to-right direction. The connecting part 173, which has a cylindrical shape with its central axis extending orthogonal to the left-to-right direction, is inserted into the piston guide part 170. Accordingly, when the toner accommodating part 153 and waste toner accommodating part 154 move, the piston guide part 170 moves relative to the connecting part 173 inserted therein.

The cylindrically-shaped sealing member 174 is interposed between the connecting part 173 and piston guide part 170 for sealing the gap therebetween. When the piston guide part 170 moves relative to the connecting part 173, the sealing member 174 prevents waste toner from leaking out through the gap between the connecting part 173 and piston guide part 170.

(7-10) The internal communication through-hole 176 is formed in the main body part 172 and communicates with the connecting part 173. The upper conveying member 171 is provided with the cylindrically-shaped shutter 178. The shutter 178 is capable of moving along the inner peripheral surface of the main body part 172 between an open position exposing the internal communication through-hole 176 and a closed position closing the internal communication through-hole 176. The operating lever 180 is coupled to the shutter 178. When the operating lever 180 is operated, the shutter 178 can be moved between the open position and closed position.

(7-11) The springs 188 are interposed between the waste toner accommodating part 154 and the upper conveying member 171 (see FIG. 15). When the position of the upper conveying member 171 is fixed relative to the photosensitive drum 6, the springs 188 urge the developing roller 66 toward the photosensitive drum 6 via the toner accommodating part 153. The toner accommodating part 153 and waste toner accommodating part 154 can be moved against the urging force of the spring 188 in a direction for separating the developing roller 66 from the photosensitive drum 6.

Further, by coupling the operating lever 180 to a portion of the shutter 178 in the left-to-right center thereof, the operating lever 180 is easy to operate. Further, the operating lever 180 can be used as a grip when moving the toner unit 11 to prevent the toner unit 11 from tipping left or right.

(7-12) The springs 188 are interposed between the upper conveying member 171 and the left and right ends of the waste toner accommodating part 154. Hence, the springs 188 can apply an urging force to the left and right ends of the waste toner accommodating part 154 and can urge the developing roller 66 toward the photosensitive drum 6 with good left-to-right balance.

While waste toner on the sheet-conveying belt 13 is the immediate target of recovery (removal) by the belt cleaner 10, the belt cleaner 10 also recovers waste toner transferred to the sheet-conveying belt 13 by the photosensitive drums 6. Therefore, the photosensitive drums 6 may also be considered targets for waste toner recovery in addition to the sheet-conveying belt 13.

As described above, the drawer frame 5 that holds the four photosensitive drums 6 can move between the accommodated position inside the main casing 2 to the pulled-out position outside of the main casing 2. The four photosensitive drums 6 are juxtaposed at intervals in the direction in which the drawer frame 5 moves. The four photosensitive drums 6 are arranged spaced apart from one another by a prescribed gap in the drawer frame moving direction. The guide parts 38 provided in the main casing 2 extend along the direction that the drawer frame 5 moves. The guided parts 35 are formed on the drawer frame 5 and are guided by the guide parts 38 when the drawer frame 5 is moved. This structure enables the drawer frame 5 to be moved smoothly between the accommodated position and the pulled-out position.

The belt cleaner 10 retained by the drawer frame 5 removes waste toner to be discarded from the sheet-conveying belt 13 and collects this toner. The belt cleaner 10 is provided in front of the black photosensitive drum 6 (the downstream side in the direction that the drawer frame 5 is pulled). A conveying mechanism configured of the auger 120, outer conveying unit 131, and upper conveying member 171 conveys waste toner collected in the belt cleaner 10 to the waste toner accommodating part 154.

The waste toner accommodating part 154 is integrated with the toner accommodating part 153 of the black toner unit 11. When the toner accommodating part 153 runs out of toner, for example, the waste toner accommodating part 154 is replaced together with the toner accommodating part 153 (i.e., replaced with a toner accommodating part 153 accommodating toner and an empty waste toner accommodating part 154). Since the integrated toner accommodating part 153 and waste toner accommodating part 154 are retained in the drawer frame 5, these integrated members can be replaced with new members without having to move the sheet-conveying belt 13. Since the waste toner accommodating part 154 is replaced at least as often as the toner accommodating part 153 runs out of toner, it is not necessary to provide the waste toner accommodating part 154 with a very large capacity.

This configuration reduces the time and effort required for replacing the waste toner accommodating part 154. Further, since the waste toner accommodating part 154 does not require a large capacity, the color printer 1 can be made more compact.

Further, the outer conveying unit 131 is disposed downstream from the downstream end of the guided part 35 relative to the direction that the drawer frame 5 is pulled out of the main casing 2, as shown in FIG. 4. This construction prevents the outer conveying unit 131 and upper conveying member 171 from contacting the guide parts 38 when the drawer frame 5 is moved, even though the outer conveying unit 131 overlaps the guide part 38 in the front-to-rear direction. As a result, the guide parts 38 can suitably guide the guided parts 35, enabling the drawer frame 5 to move smoothly.

The outer conveying unit 131 is disposed on the left side of the left side plate 31. The auger 120 conveys waste toner collected by the belt cleaner 10 leftward. The outer conveying unit 131 conveys waste toner received from the auger 120 in a direction diagonally upward and forward and orthogonal to the left-to-right direction.

The left and right guided parts 35 protrude outward from the respective side plates 31 and 32 of the drawer frame 5 in the left and right directions. The outer conveying unit 131 is positioned in front of the left guided part 35 and overlaps this guided part 35 in the front-to-rear direction. Hence, even though the outer conveying unit 131 is provided on the left side of the left side plate 31, this configuration suppresses an increase in the left-to-right dimension of the color printer 1.

The upper conveying member 171 conveys waste toner received from the outer conveying unit 131 toward the waste toner accommodating part 154. The outer conveying unit 131 and upper conveying member 171 are connected on the left side of the left side plate 31 at a position forward of the left guided part 35. Hence, the upper conveying member 171 can be positioned to avoid the guided parts 35 and other members provided on the drawer frame 5. Further, this configuration prevents the upper conveying member 171 from interfering with the toner unit 11 when the toner unit 11 is mounted in or removed from the drawer frame 5. Even though the connecting portion of the outer conveying unit 131 and upper conveying member 171 is positioned on the left side of the left side plate 31, this configuration suppresses an increase in the left-to-right dimension of the drawer unit 3.

The drawer frame 5 includes the front beam 33 and rear beam 34 that span between the side plates 31 and 32. The outer conveying unit 131 is disposed in a position that overlaps the front beam 33 in the width direction. This configuration avoids an increase in the front-to-rear dimension of the drawer unit 3.

The guided parts 35 extend to a position farther rearward than the rear beam 34. Accordingly, when the drawer unit 3 is moved to the pulled-out position outside the main casing 2, as shown in FIGS. 2 and 3, the rear ends of the guided parts 35 can remain supported in the front ends of the guide parts 38. Hence, the drawer unit 3 can be held in the pulled-out position.

While the invention has been described with reference to one embodiment, the invention may be implemented according to other embodiments.

8. Other Embodiments

In the first embodiment described above, the shutter operating members 80 and manual operating members 95 are positioned so that their respective centers respectively overlap in a side view, as the relative positional relationships between the coupling protrusions 83 of the shutter operating members 80 and the corresponding manual operating members 95 reveal in FIGS. 10 and 11. Accordingly, the peripheral surface of each developing roller 66 (main developing roller body 67) is in contact with the surface of the corresponding photosensitive drum 6, as shown in FIGS. 8 and 9, no matter the position of the inner cylindrical body 159 in the corresponding toner unit 11 (i.e., whether the inner cylindrical body 159 covers or exposes the first outer-body-side supply through-hole 156; see FIGS. 17 and 18). More specifically, in each developing unit 8, a distance between the rotational center of the operating member 80 and a point where the developing roller 66 contacts the photosensitive drum 60 is referred to as distance A. The distance A is a fixed distance. In the drawer frame 5, a distance between the rotational center of each manual operating member 95 and a point where the corresponding photosensitive drum 60 contacts the developing roller 66 is referred to as distance B. The distance B is also a fixed distance. According to the embodiment described above, the distances A and B are equal to each other.

Figure 27:
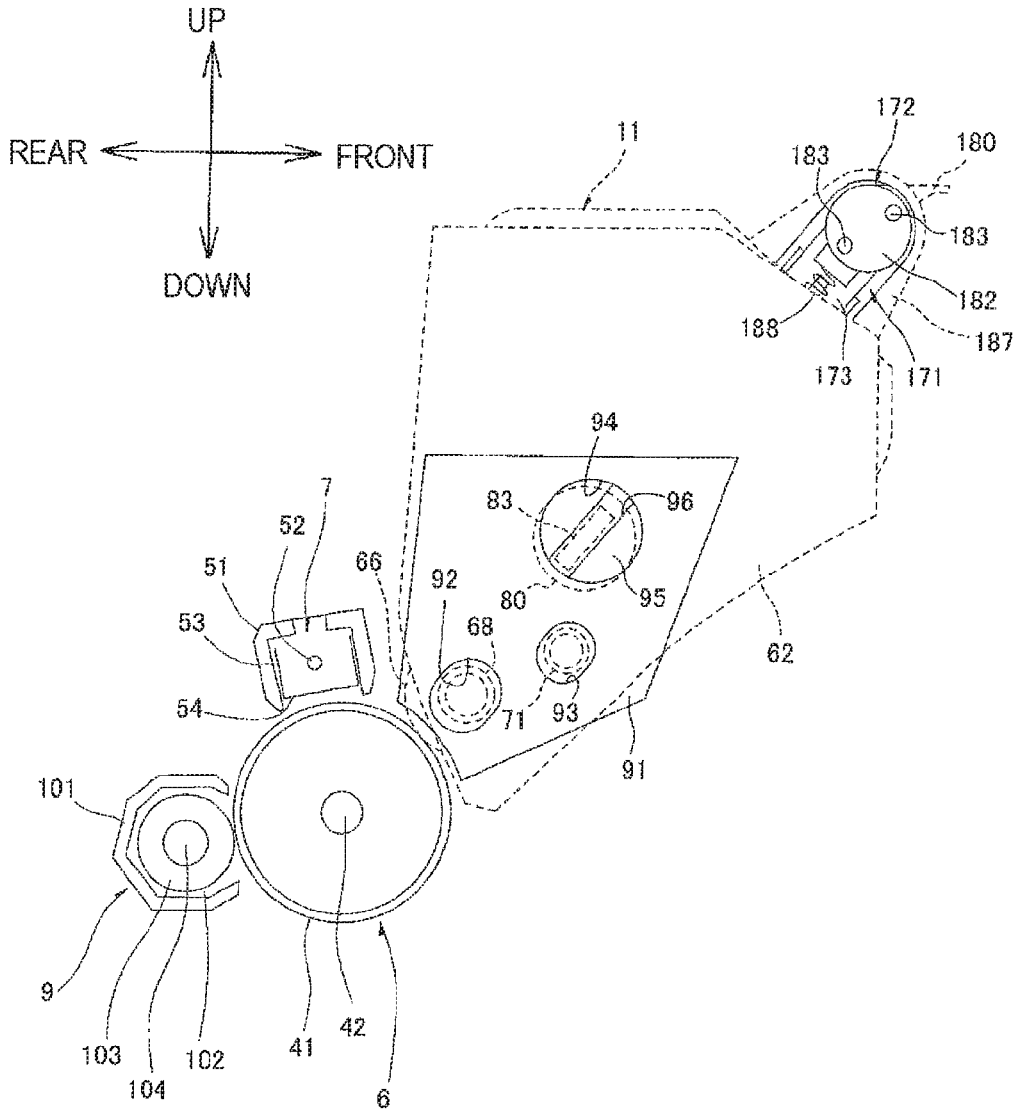
FIG. 27 is a cross-sectional view schematically showing an essential part of a color printer according to another embodiment of the present invention, in which a developing roller for black contacts a corresponding photosensitive drum.
Figure 28:
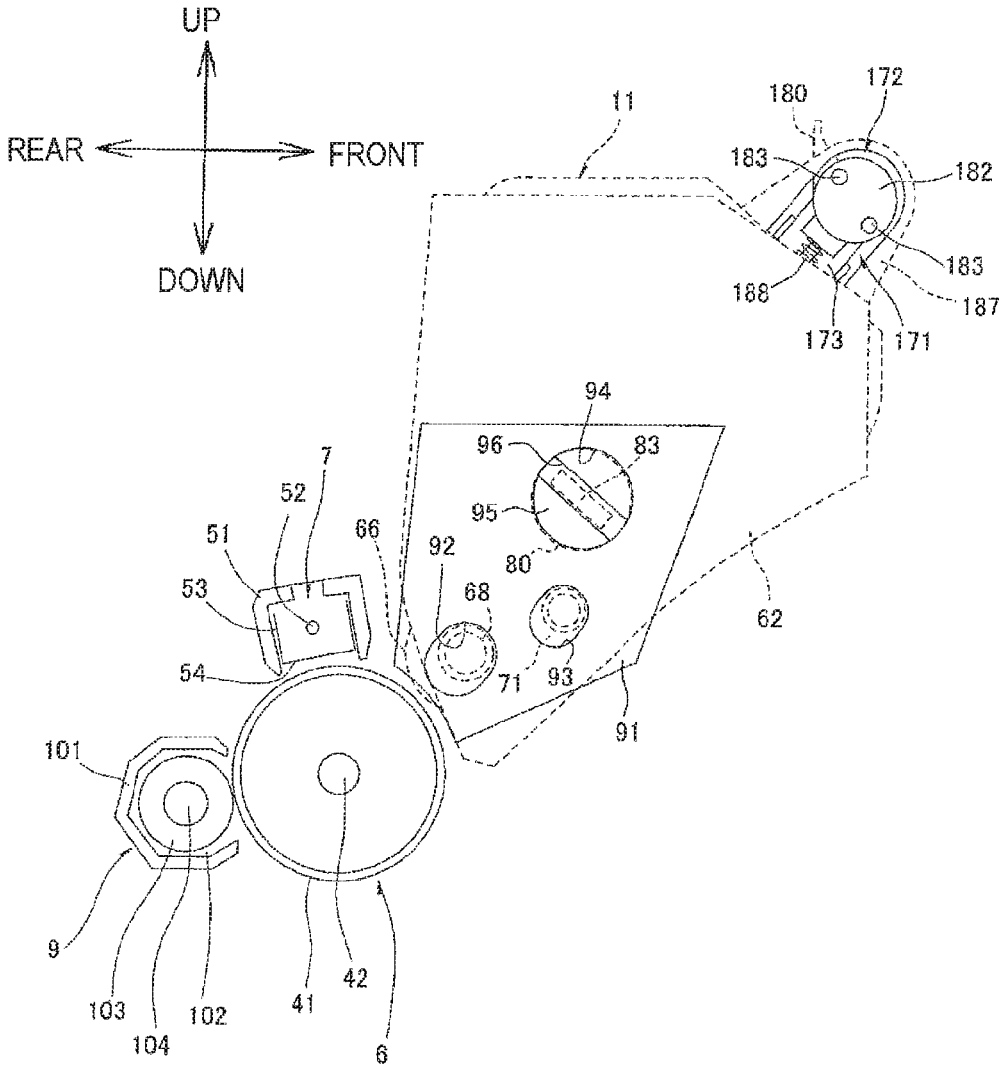
FIG. 28 is a cross-sectional view schematically showing the essential part of the color printer of FIG. 27, in which the developing roller for black separates from the corresponding photosensitive drum.
Figure 29:
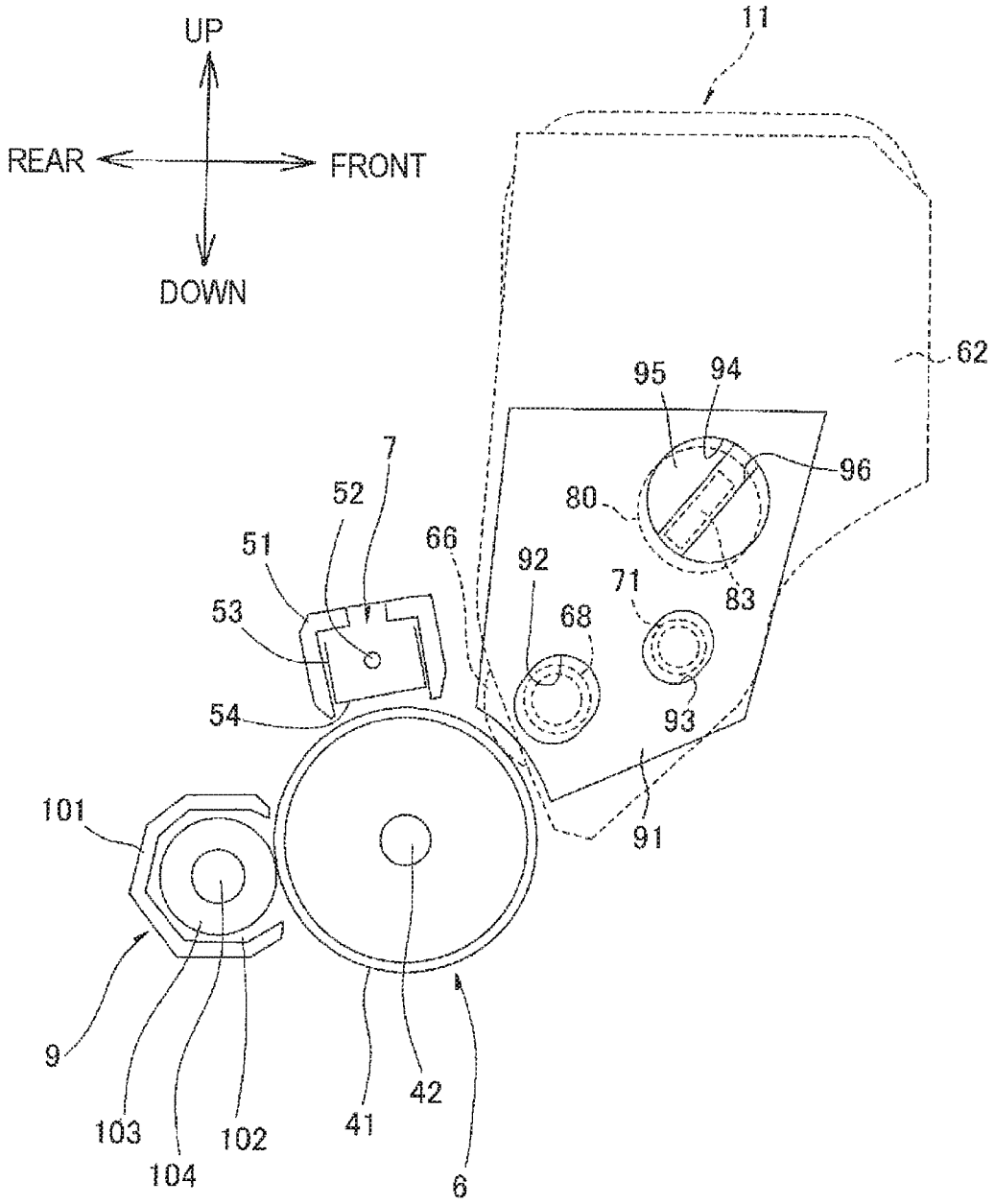
FIG. 29 is a cross-sectional view schematically showing an essential part of the color printer of FIG. 27, in which a developing roller for yellow, cyan, or magenta contacts a corresponding photosensitive drum.
Figure 30:
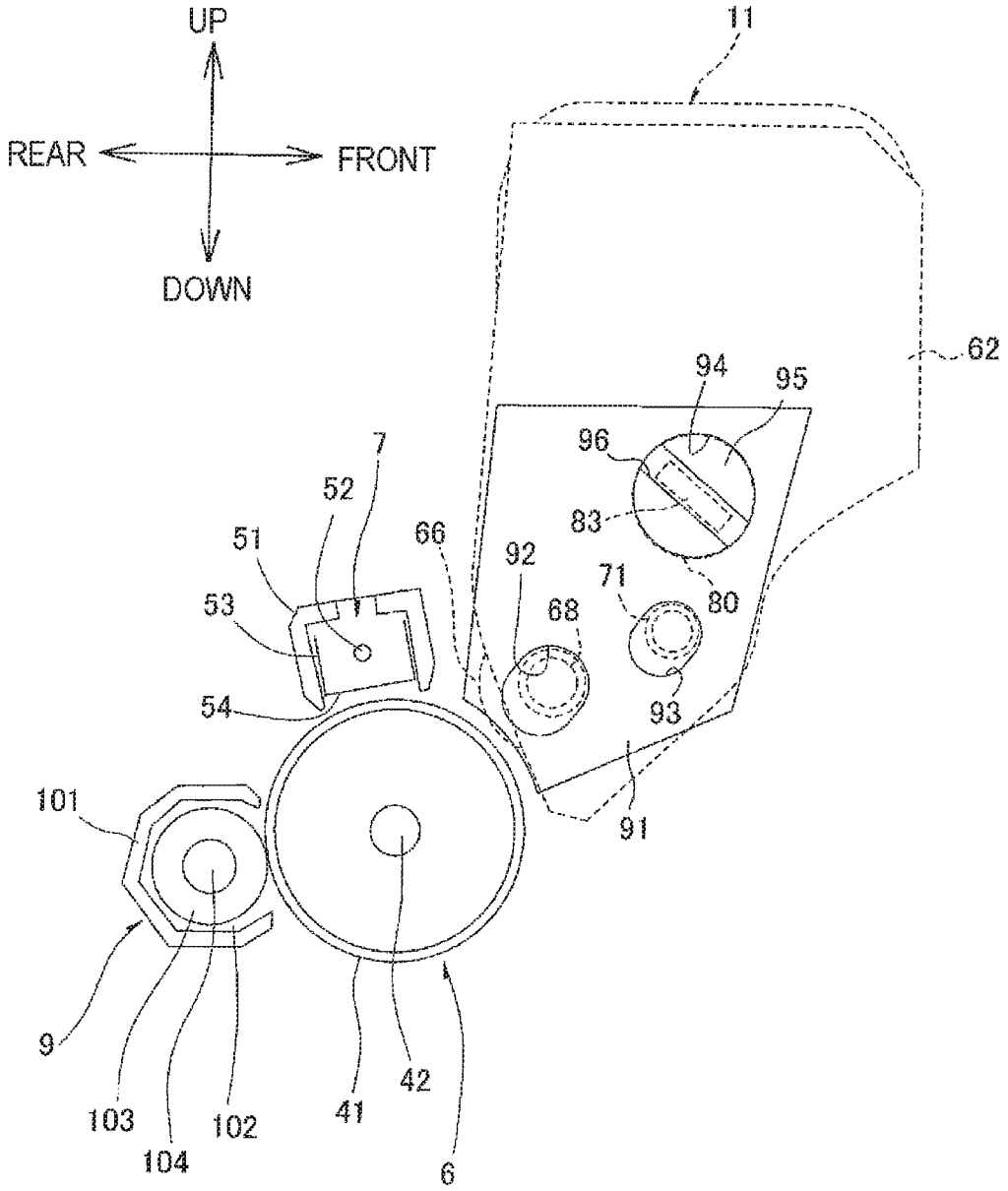
FIG. 30 is a cross-sectional view schematically showing the essential part of the color printer of FIG. 27, in which the developing roller for yellow, cyan, or magenta separates from the corresponding photosensitive drum.

However, with the configuration shown in FIGS. 27, 28, 29, and 30, when the inner cylindrical body 159 is in the open position shown in FIGS. 27 and 29, the center position of the manual operating member 95 is slightly offset from the center position of the shutter operating member 80 in a direction in which the developing roller 66 is separated from the photosensitive drum 6 along the elongated direction of the second engagement groove 96 (i.e., upward and forward). In other words, the distance A is smaller than the distance B. When the manual operating member 95 is rotated 90 degrees clockwise from the position shown in FIGS. 27 and 29 (with the second engagement groove 96 sloping upward and forward), the coupling protrusion 83 of the shutter operating member 80 is pulled upward by the second engagement groove 96 as the second engagement groove 96 rotates clockwise. Through this operation, the inner cylindrical body 159 is rotated from the open position to the closed position while the developing unit 8 moves obliquely upward and forward and the developing roller 66 separates from the photosensitive drum 6, as illustrated in FIGS. 28 and 30.

9. Operations (9-1) The toner unit 11 is provided with the left and right enclosing plates 162 and 193 coupled to the inner cylindrical body 159. The developing unit 8 is provided with the shutter operating member 80. When the toner unit 11 is mounted in the developing unit 8 (in the mounting space 64), the shutter operating member 80 (first engagement grooves 82), left enclosing plate 162 (engaging bosses 163), and right enclosing plate 193 (engaging bosses 194) are all engaged.

The left and right developing unit support plates 91 provided integrally with the drawer frame 5 function to retain the corresponding manual operating members 95. When the inner cylindrical body 159 is in the open position, the manual operating members 95 are in a guiding orientation for guiding the coupling protrusions 83 of the corresponding shutter operating members 80 in a direction for pressing the developing roller 66 against the photosensitive drum 6. On the other hand, when the inner cylindrical body 159 is in the closed position, the manual operating members 95 are in a non-guiding orientation extending in a direction intersecting the pressing direction. Hence, this configuration for guiding the coupling protrusions 83 in the manual operating members 95 when the manual operating members 95 are in the guiding orientation can suitably move the developing unit 8 in the pressing direction.

(9-2) The left and right enclosing plates 162 and 193 are provided so as to rotate together with the inner cylindrical body 159. The left and right shutter operating members 80 are provided for rotating together with the left and right enclosing plates 162 and 193, respectively. The manual operating members 95 can also rotate. When the manual operating members 95 are rotated from the guiding orientation to the non-guiding orientation, the shutter operating members 80, left enclosing plate 162, and right enclosing plate 193 also rotate while their rotational centers move in a direction for separating the developing roller 66 from the photosensitive drum 6. This configuration can move the inner cylindrical body 159 from the open position to the closed position and can move the developing unit 8 in a direction upward and forward, thereby separating the developing roller 66 from the photosensitive drum 6.

With this construction, the developing roller 66 can be held in a state separated from the photosensitive drum 6 when the inner cylindrical body 159 is in the closed position. This can prevent deterioration of the photosensitive drum 6 caused by chemical agents present on the developing roller 66, and deterioration of the developing roller 66 due to compression set.

Here, the developing unit 8 may simply be moved obliquely upward and forward a distance sufficient to relieve the pressing state of the developing roller 66 against the photosensitive drum 6; the developing roller 66 need not be separated from the photosensitive drum 6. In other words, the developing unit 8 may be allowed to move in the pressing direction (downward and rearward) for pressing the developing roller 66 against the photosensitive drum 6 when the inner cylindrical body 159 is in the open position and to restrict such movement in the pressing direction when the inner cylindrical body 159 is in the closed position. Relieving the pressure applied to the photosensitive drum 6 by the developing roller 66 can reduce wear and tear on both members.

10. Variations of the Embodiments 10-1. First Variation

Figure 31:
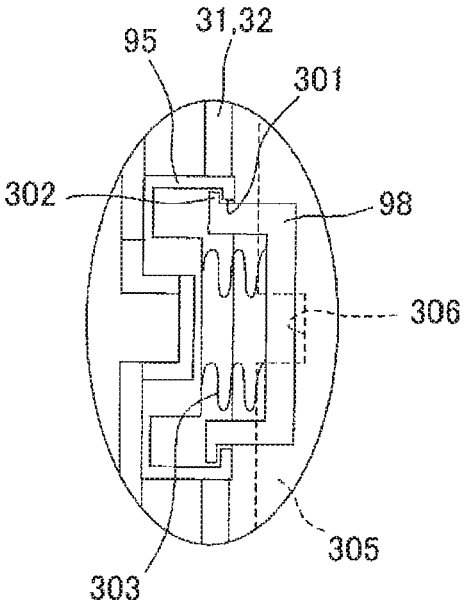
FIG. 31 is a sectional view of an operating knob according to a first variation, in which the operating knob protrudes outside the manual operating member.
Figure 32:
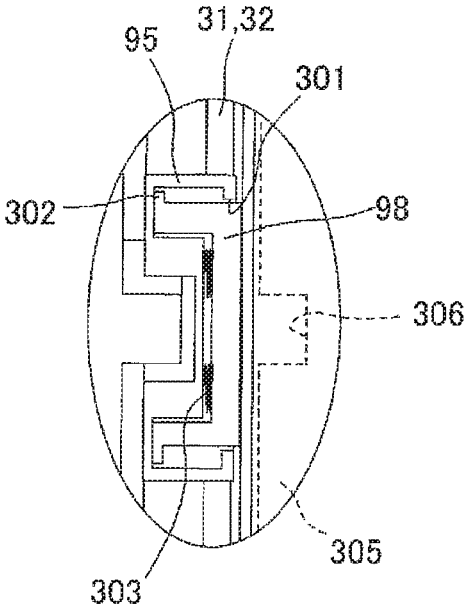
FIG. 32 is a sectional view of the operating knob of FIG. 31, in which the operating knob is retracted inside the manual operating member.

As shown in FIGS. 31 and 32, the operating knobs 98 may be configured to advance and retract in the left and right directions relative to the corresponding manual operating members 95. Here, the manual operating members 95 have a hollow structure. An insertion through-hole 301 that is rectangular in a side view is formed in the outer surface of the manual operating member 95. The operating knob 98 has an angular C-shape in cross section, the ends of which are inserted into the insertion through-hole 301. Engaging parts 302 are formed on the ends of the operating knob 98 for engaging with the peripheral edge of the insertion through-hole 301. A coil spring 303 is interposed between the manual operating member 95 and operating knob 98.

When the operating knob 98 is pressed toward the manual operating member 95 against the urging force of the coil spring 303, the operating knob 98 is retracted inside the manual operating member 95, as illustrated in FIG. 32. When the pressure on the operating knob 98 is relaxed, the urging force of the coil spring 303 pushes the operating knob 98 out of the manual operating member 95, as shown in FIG. 31.

Figure 33:
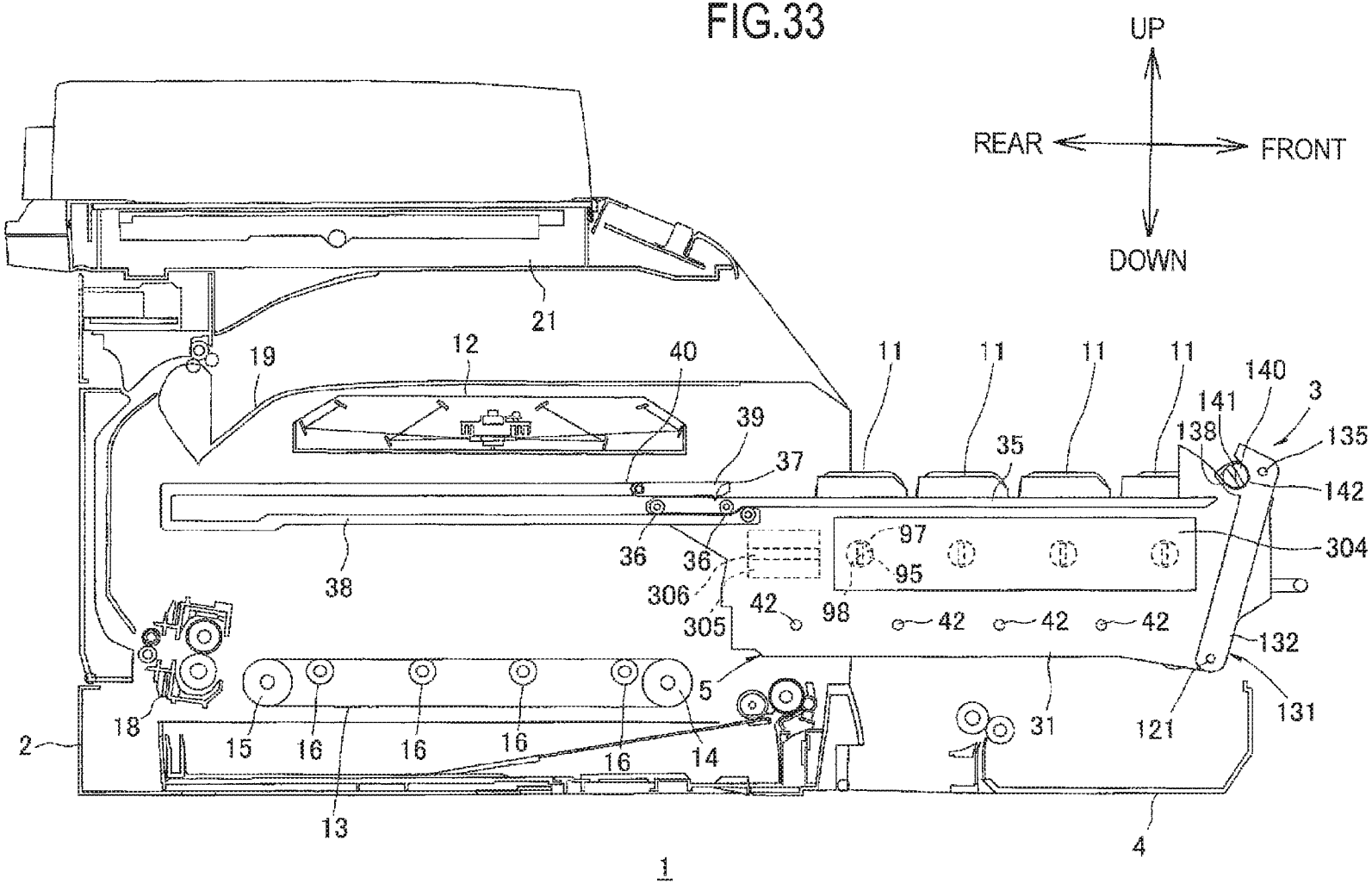
FIG. 33 is a cross-sectional view of a color printer, to which the configuration of FIGS. 31 and 32 is applied, and showing the state, in which a cover for maintaining the operating knobs in their retracted states is attached.

When employing this construction, it is preferable to provide a cover 304, as shown in FIG. 33, for maintaining the operating knobs 98 in their retracted state inside the manual operating members 95. The cover 304 is rectangular in a side view and formed large enough to cover all four operating knobs 98. With the cover 304 pressing in the four operating knobs 98 so that the operating knobs 98 are retracted inside the manual operating members 95, the cover 304 can be engaged in the side plates 31 and 32 to maintain the operating knobs 98 in their retracted state.

When the color printer 1 is packaged as a product or is left unused for an extended period of time, for example, it is preferable that the cover 304 be mounted on the drawer frame 5 to maintain the toner accommodating part 153 and cases 201 in the toner units 11 and the developing chambers 63 of the corresponding developing units 8 in a non-communicative state. By doing so, it is possible to prevent any toner from leaking out of the toner units 11. Especially, in the embodiment of FIGS. 27-30, it is further possible to keep the developing rollers 66 separated from the photosensitive drums 6. By doing so, it is possible to prevent wear and tear on the photosensitive drums 6 and developing rollers 66.

A failsafe member 305 is preferably also provided in the main casing 2 at a position aligned with the operating knobs 98 in the front-to-rear direction. A groove 306 is formed in the failsafe member 305 for allowing the operating knobs 98 to pass when pushing the drawer unit 3 (drawer frame 5) from the pulled-out position to the accommodated position as long as the operating knobs 98 are extending in the front-to-rear direction, but prevents the passage of any operating knob 98 oriented vertically.

In other words, if any of the operating knobs 98 are aligned with the vertical or if the user has forgotten to attach the cover 304, the operating knobs 98 will collide with the failsafe member 305 when the drawer unit 3 moves from the pulled-out position toward the accommodated position. Hence, this construction can prevent the drawer unit 3 from being returned to the accommodated position while the developing chambers 63 of the developing units 8 are not in communication with the toner accommodating part 153 and cases 201 of the toner units 11.

10-2. Second Variation

Figure 34:
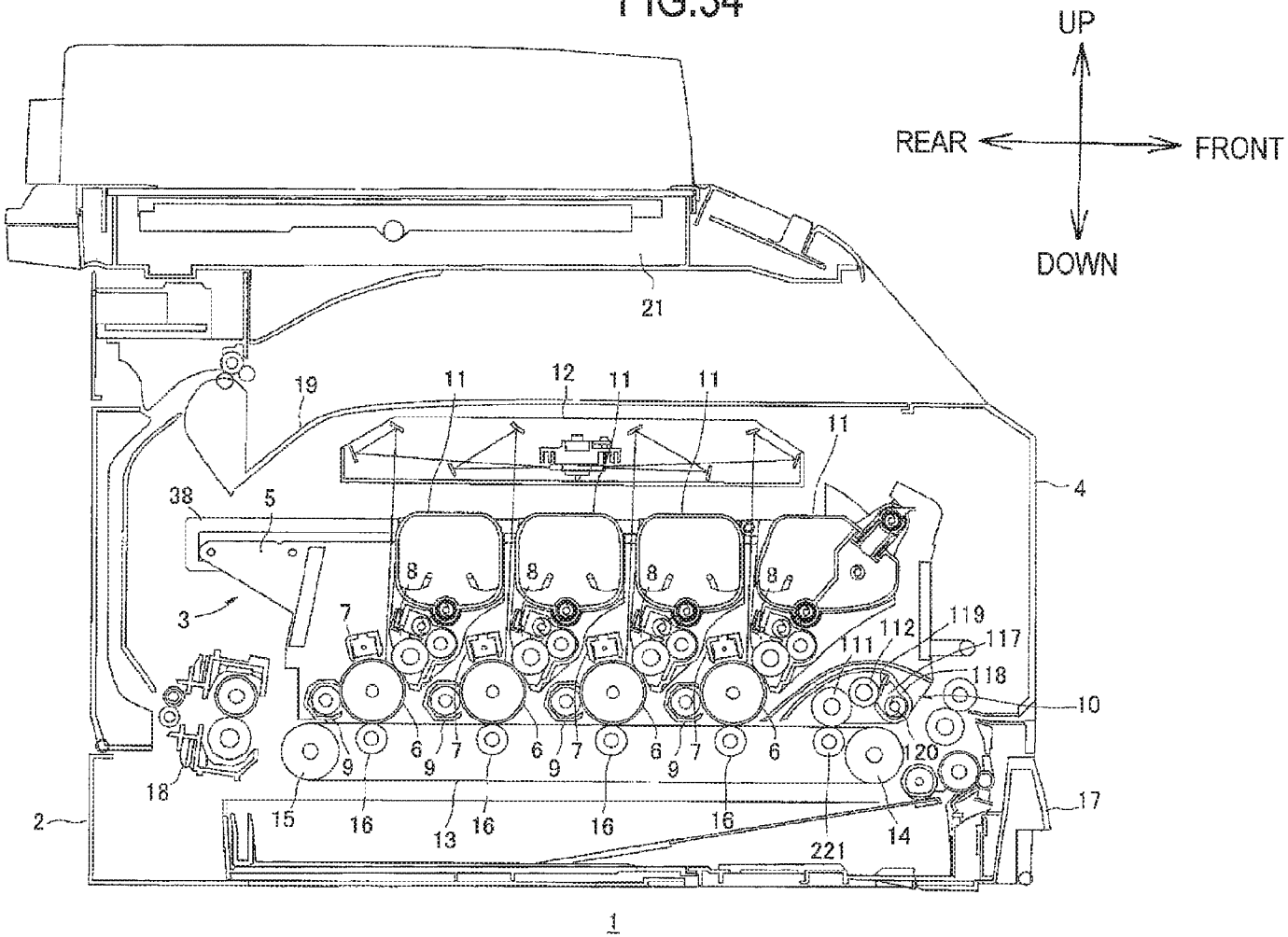
FIG. 34 is a cross-sectional view of a color printer according to a second variation, in which a backup roller is provided in a position confronting a primary belt cleaning roller.

As shown in FIG. 34, the belt cleaner 10 may be configured so that the primary belt cleaning miler 111 contacts the upper flat portion of the sheet-conveying belt 13 near the front end thereof. In this case, a backup roller 221 is disposed in a position confronting the primary belt cleaning roller 111 through the flat portion of the sheet-conveying belt 13.

10-3. Third Variation

Figure 35:
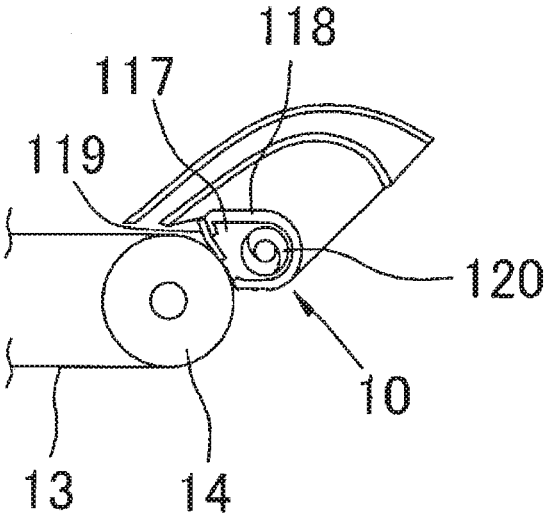
FIG. 35 is a cross-sectional view of a belt cleaner according to a third variation.

As shown in FIG. 35, the primary and secondary belt cleaning rollers 111 and 112 may be omitted from the belt cleaner 10, and the distal edge of the scraper 119 may be positioned to contact the sheet-conveying belt 13 directly.

10-4. Fourth Variation

Figure 36:
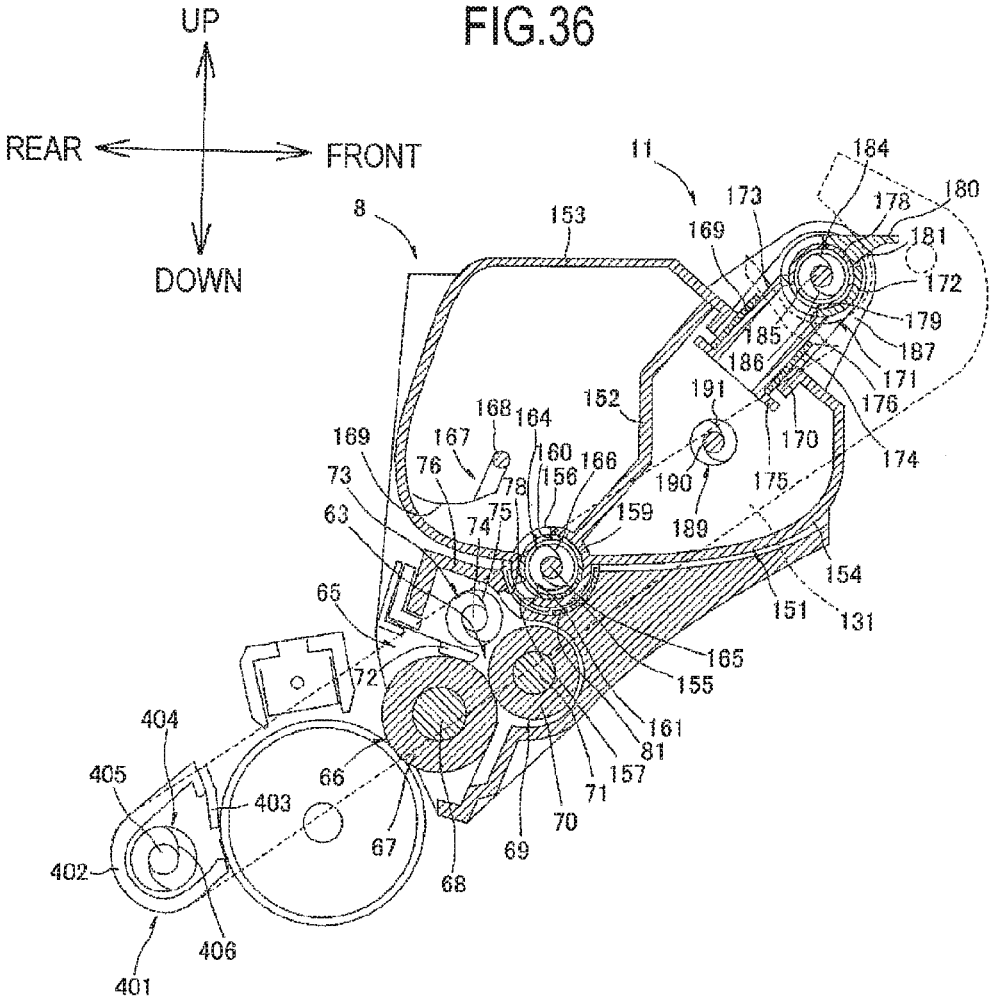
FIG. 36 is a cross-sectional view schematically showing an essential part of a color printer of a third variation, in which a drum cleaner serves as a recovering unit.

The belt cleaner 10 described in the embodiments is one example of a recovery unit applying the present invention. However, the present invention may be applied to a recovery unit such as a drum cleaner 401 shown in FIG. 36. The drum cleaner 401 recovers waste toner from the surface of the photosensitive drum 6.

The drum cleaner 401 is provided with a case 402. The case 402 has a general C-shape in cross section and opens toward the photosensitive drum 6.

A scraper 403 is attached to the top edge of the case 402. The scraper 403 has a plate shape and extends downward from the front edge of the case 402. The bottom edge of the scraper 403 contacts the surface of the photosensitive drum 6 on the rear side thereof.

An auger 404 is disposed inside the case 402. The auger 404 is configured of an auger shaft 405 oriented in the left-to-right direction, and an auger screw 406 that is formed in a helical shape around the circumference of the auger shaft 405. The right end of the auger shaft 405 is rotatably supported in the right side plate 32 (see FIG. 8).

The outer conveying unit 131 extends obliquely upward and forward from a position confronting the drum cleaner 401 in the left-to-right direction. The left end of the auger shaft 405 is rotatably supported in the bottom end of the opposing wall 132 constituting the outer conveying unit 131.

As the photosensitive drum 6 rotates, waste toner carried on the surface of the photosensitive drum 6 is scraped off by the scraper 403. The waste toner scraped off the surface of the photosensitive drum 6 is received in the case 402. The auger 404 rotating inside the case 402 conveys toner in the case 402 leftward and supplies the toner into the outer conveying unit 131 (the waste toner conveying chamber 134).

While the invention has been described in detail with reference to the embodiments and variations thereof, it would be apparent to those skilled in the art that various changes and modifications may be made therein without departing from the spirit of the invention.

What is claimed is:

1. An image-forming device, comprising:

a holding member;

a photosensitive body held by the holding member;

a developing unit having a developer material bearing body, the developer material bearing body being configured to bear developer material thereon and supply developer material from the developer material bearing body to a surface of the photosensitive body;

a developer cartridge that can be mounted in and detached from the developing unit and that has a case and a shutter, the case being formed with a through-hole, through which developer material accommodated inside the case is supplied to the developing unit, the shutter being configured so as to be capable of moving between an open position opening the through-hole and a closed position closing the through-hole; and a developing unit movement control mechanism that is configured to allow the developing unit to move in a pressing direction for pressing the developer material bearing body against the photosensitive body when the shutter is in the open position and to restrict the movement in the pressing direction when the shutter is in the closed position.

2. The image-forming device as claimed in claim 1, wherein the developing unit movement control mechanism includes:

a first operating member that is provided to the developer cartridge and that is coupled to the shutter;

a second operating member that is provided to the developing unit, that has a guided portion, and that is configured to be engaged with the first operating member when the developer cartridge is mounted in the developing unit; and a guiding member that is provided to the holding member and that is configured to be in a guiding orientation extending in the pressing direction to guide the guided portion in the pressing direction when the shutter is in the open position, and to be in a non-guiding orientation extending in a direction intersecting the pressing direction to restrict movement of the guided portion in the pressing direction when the shutter is in the closed position.

3. The image-forming device as claimed in claim 2, wherein the first operating member is configured to rotate together with the shutter, the second operating member is configured to rotate together with the first operating member when the second operating member is engaged with the first operating member, and the guiding member is configured to rotate relative to the holding member, and wherein when the guiding member is rotated from the guiding orientation to the non-guiding orientation, the guiding member rotates the first operating member and the second operating member to move the shutter from the open position to the closed position, while moving rotational centers of the first operating member and the second operating member in a direction to separate the developer material bearing body away from the photosensitive body.

* * * * *